US009170560B2

(12) United States Patent
Hattori et al.

(10) Patent No.: US 9,170,560 B2
(45) Date of Patent: Oct. 27, 2015

(54) IMAGE FORMING APPARATUS

(71) Applicants: Yoshiteru Hattori, Ichinomiya (JP); Shinji Ohashi, Anjo (JP)

(72) Inventors: Yoshiteru Hattori, Ichinomiya (JP); Shinji Ohashi, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/032,256

(22) Filed: Sep. 20, 2013

(65) Prior Publication Data

US 2014/0086626 A1 Mar. 27, 2014

(30) Foreign Application Priority Data

Sep. 21, 2012 (JP) ..... 2012-208914

(51) Int. Cl.
*G03G 21/18* (2006.01)
*G03G 21/16* (2006.01)

(52) U.S. Cl.
CPC ..... *G03G 21/1817* (2013.01); *G03G 21/1647* (2013.01); *G03G 21/1839* (2013.01)

(58) Field of Classification Search
USPC ..... 399/111
See application file for complete search history.

(56) References Cited

U.S. PATENT DOCUMENTS

| | | | | |
|---|---|---|---|---|
| 8,032,057 | B2 | 10/2011 | Takahashi et al. | |
| 8,478,159 | B2 | 7/2013 | Kinoshita | |
| 8,483,596 | B2 | 7/2013 | Seorl et al. | |
| 2007/0166074 | A1 * | 7/2007 | Hosokawa et al. | 399/111 |
| 2008/0226319 | A1 | 9/2008 | Takahashi et al. | |
| 2009/0016768 | A1 | 1/2009 | Seorl et al. | |
| 2010/0329735 | A1 | 12/2010 | Kinoshita | |
| 2012/0301183 | A1 | 11/2012 | Seorl et al. | |

FOREIGN PATENT DOCUMENTS

| | | | |
|---|---|---|---|
| JP | H11-218983 | A | 8/1999 |
| JP | 2006-154614 | * | 6/2005 |
| JP | 2006-071671 | A | 3/2006 |
| JP | 2006-154614 | A | 6/2006 |
| JP | 2006-171407 | A | 6/2006 |

(Continued)

OTHER PUBLICATIONS

Photographs of Samsung Color Laser Multifunction Printer, Model CLX4195FW, Samsung Electronics Co., Ltd., May 2012.

(Continued)

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming apparatus includes a main body including a fixing portion, a cartridge including a photosensitive member, a transfer unit disposed facing the photosensitive member of the cartridge, and a separation member configured to separate the photosensitive member from the transfer unit and including a fixing portion. The cartridge is configured to be disposed in a first position in the main body where the photosensitive member is separated from the transfer unit and in a second position in the main body where the photosensitive member contacts the transfer unit. When the separation member is fixed in the main body by engagement of the fixing portion of the separation member to the fixing portion of the main body, the cartridge is disposed in the first position, and when the separation member is removed from the main body, the cartridge is disposed in the second position.

18 Claims, 17 Drawing Sheets

(56) References Cited

FOREIGN PATENT DOCUMENTS

| | | | |
|---|---|---|---|
| JP | 2006-267606 | A | 10/2006 |
| JP | 2006-330481 | A | 12/2006 |
| JP | 2008-233182 | A | 10/2008 |
| JP | 2009-020515 | A | 1/2009 |
| JP | 2009-265571 | A | 11/2009 |
| JP | 2011-013292 | A | 1/2011 |
| JP | 2011-133914 | A | 7/2011 |

OTHER PUBLICATIONS

Quick Installation Guide for Samsung Color Laser Multifunction Printer, Model CLX4195FW, Samsung Electronics Co., Ltd., May 2012.

* cited by examiner

IMAGE FORMING APPARATUS

CROSS REFERENCE TO RELATED APPLICATION

This application claims priority from Japanese Patent Application No. 2012-208914, filed on Sep. 21, 2012, which is incorporated herein by reference in its entirety.

TECHNICAL FIELD

Aspects of the disclosure relate to an electrophotographic image forming apparatus.

BACKGROUND

A known electrophotographic image forming apparatus, e.g., a printer, includes a main body and a cartridge that contains developer therein and is detachably attachable to the main body.

When such a printer is packed in a carton, it may be considered that the cartridge is mounted in the printer to reduce the size of the carton.

For example, there is a color image forming apparatus including process cartridges having photosensitive drums, a conveyance belt disposed facing the photosensitive drums, and transfer rollers disposed inside the conveyance belt and facing the photosensitive drums via the belt. When the color image forming apparatus is packed in a carton, the process cartridges are mounted in the color image forming apparatus.

The color image forming apparatus further includes state changing members each configured to move a transfer roller into or out of contact with a corresponding photosensitive drum. The color image forming apparatus is configured such that the state changing members maintain the transfer rollers separated from the photosensitive drums until the power is turned on for the first time, and moves the transfer rollers into contact with the photosensitive drums when the power is turned on for the first time.

SUMMARY

However, the state changing members of the color image forming apparatus are actuated only when the power is turned on for the first time.

In other words, the state changing members become unnecessary during normal image formation. The color image forming apparatus includes such state charging members, and thus the structure of the apparatus is complicated.

Illustrative aspects of the disclosure provide an image forming apparatus intended to be transported with a cartridge fixed in a main body with a simple structure.

According to an aspect of the disclosure, an image forming apparatus includes a main body including a fixing portion, a cartridge including a photosensitive member and configured to be mounted in and removed from the main body, a transfer unit disposed facing the photosensitive member of the cartridge mounted in the main body, and a separation member configured to separate the photosensitive member from the transfer unit. The separation member includes a fixing portion configured to engage the fixing portion of the main body. The cartridge is configured to be disposed in a first position in the main body where the photosensitive member is separated from the transfer unit. The cartridge is configured to be disposed in a second position in the main body where the photosensitive member contacts the transfer unit. When the separation member is fixed in the main body by engagement of the fixing portion of the separation member to the fixing portion of the main body, the cartridge is disposed in the first position, and when the separation member is removed from the main body, the cartridge is disposed in the second position.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a laser printer 1, as an example of an image forming apparatus, will be described in detail. The laser printer 1 is an electrophotographic color printer configured to form color toner images directly on a sheet P.

In the following description, orientations or sides of the printer 1 will be identified based on the color laser printer disposed in an orientation in which it is intended to be used or disposed horizontally. In other words, in FIG. 1, the up side is referred to as the top or upper side, the down side is referred to as the bottom or lower side, the left side is referred to as the front or front side, and the right side is referred to as the rear or the rear side. The top-bottom direction may be referred to as a vertical direction.

Figure 1:
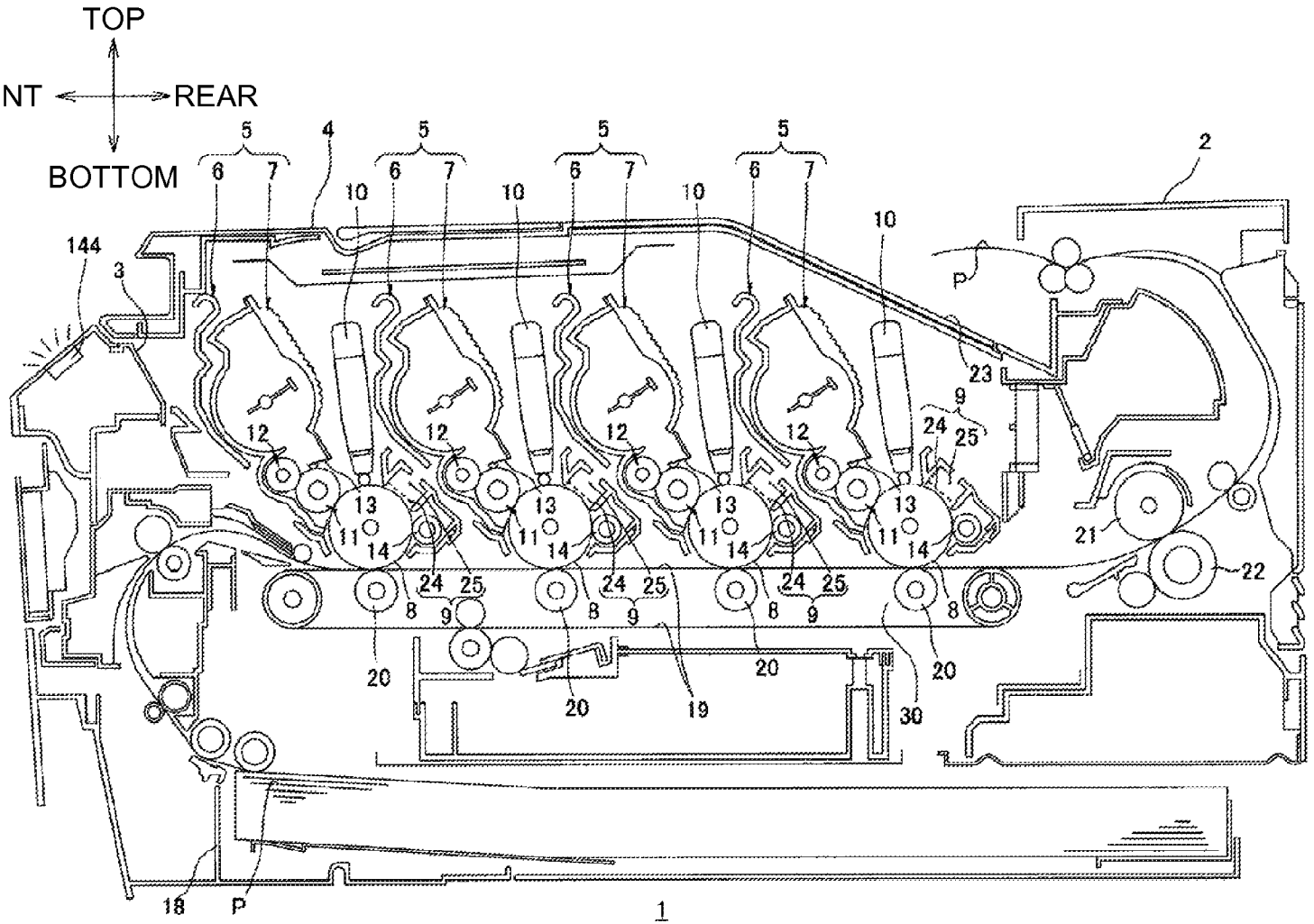
FIG. 1 is a sectional view of an illustrative image forming apparatus, e.g. a printer, according to an embodiment of the disclosure.

As shown in FIG. 1, the printer 1 includes a substantially box-shaped main body casing 2 as an example of a main body. The upper end portion of the main body casing 2 is provided with a top cover 4 configured to pivot about its rear end to open and close an opening 3. The printer 1 includes a plurality of, e.g., four, process cartridges 5.

The process cartridges 5, which are detachable from the main body casing 2, are disposed in the main body casing 2 such that they are spaced apart from each other in a line. The process cartridges 5 store yellow toner, magenta toner, cyan toner and black toner, respectively.

Each process cartridge 5 includes a drum cartridge 6 as an example of a photosensitive member unit, and a developing cartridge 7 as an example of a developing unit, which is detachably mounted in the drum cartridge 6.

The drum cartridge 6 includes a photosensitive drum 8 as an example of a photosensitive member, a scorotron charger 9, and a drum cleaning roller 14.

The photosensitive drum 8 is rotatably supported at a rear end portion of the drum cartridge 6. The photosensitive drum 8 is substantially cylindrically shaped and elongated in the left-right direction.

The scorotron charger 9 is disposed in spaced opposing relation to the photosensitive drum 8. The scorotron charger 9 includes a grid 24 and a wire 25.

Figure 14:
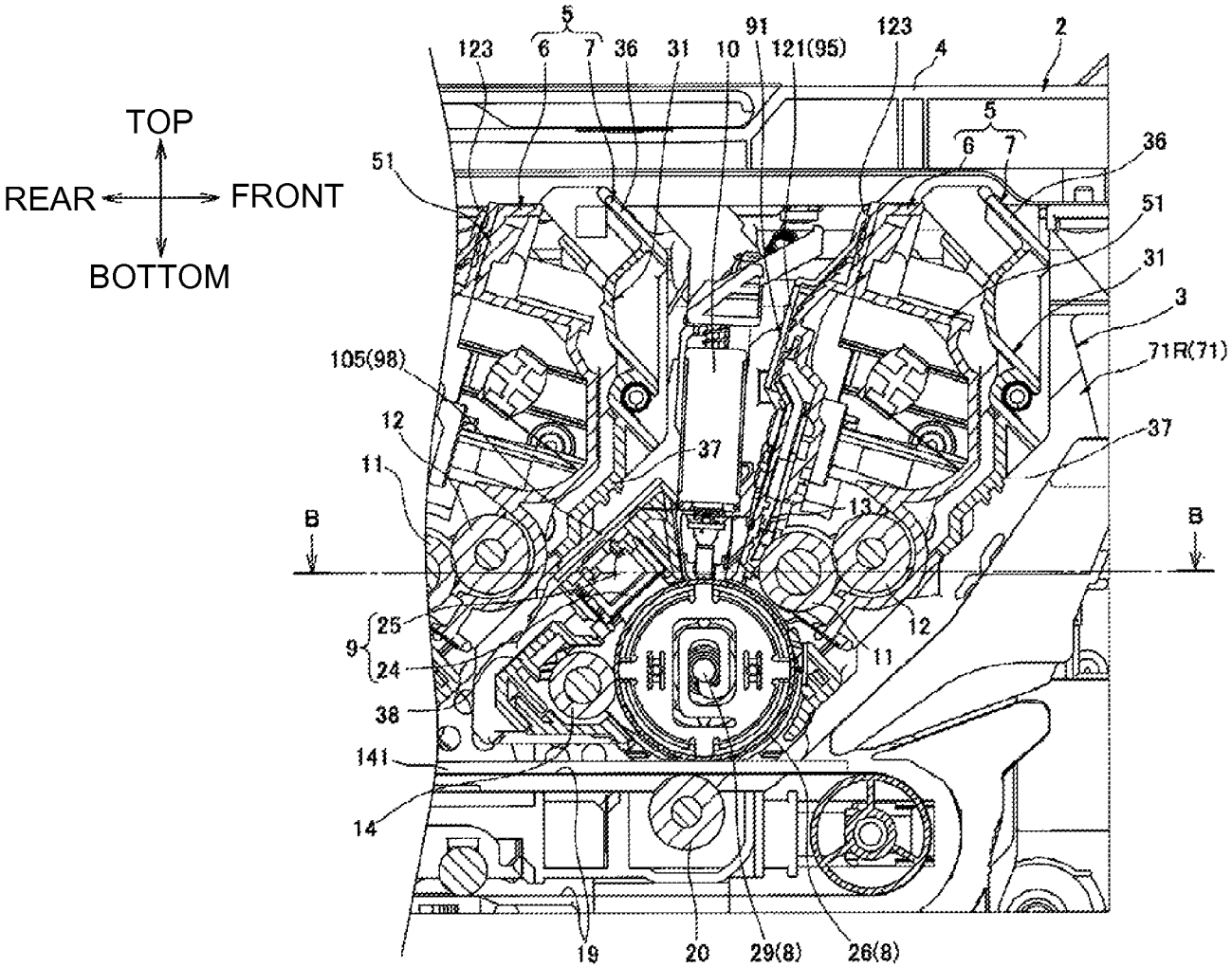
FIG. 14 is a sectional view of the printer, when viewed from the left side, where the process cartridge is mounted in the main body casing.
Figure 15:
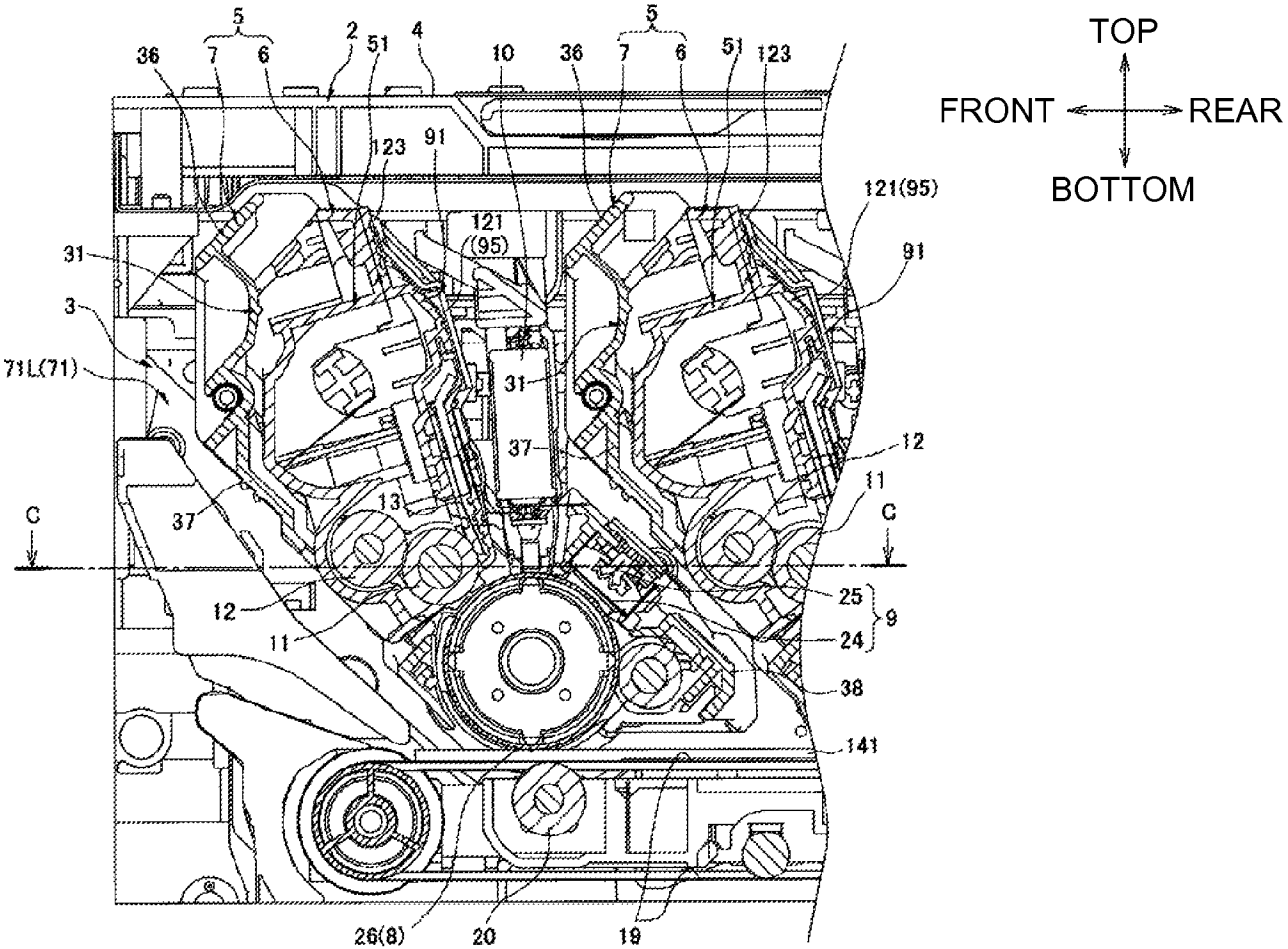
FIG. 15 is a sectional view of the printer, when viewed from the right side, where the process cartridge is mounted in the main body casing.

The grid 24 is made of metal, and has substantially an angular shape, which is open toward the upper rear side, and is elongated in the left-right direction. The shape of the grid 24 in cross section is shown in FIGS. 14 and 15. The grid 24 has a plurality of slits extending in the left-right direction.

The wire 25 is made of metal and extends in the grid in the left-right direction.

The drum cleaning roller 14 is rotatably supported at the rear end portion of the drum cartridge 6 so as to contact the photosensitive drum 8 from the rear side. The drum cleaning roller 14 is substantially cylindrically shaped and elongated in the left-right direction.

The developing cartridge 7 includes a developing roller 11 as an example of a developer carrier and a supply roller 12 configured to supply toner to the developing roller 11.

The developing roller 11 is disposed at the rear end portion of the developing cartridge 7 and exposed from the rear side so as to contact the photosensitive drum 8 from the upper front side. The developing roller 11 is substantially cylindrically shaped and elongated in the left-right direction.

The supply roller 12 is disposed on the upper front side of the developing roller 11 so as to contact 11. The supply roller 12 is substantially cylindrically shaped and elongated in the left-right direction.

The developing cartridge 7 includes a layer thickness regulating blade 13 configured to regulate a thickness of toner supplied to the developing roller 11. The developing cartridge 7 contains toner as an example of developer above the developing roller 11 and the supply roller 12.

Toner in the developing cartridge 7 is positively charged between the supply roller 12 and the developing roller 11 by friction, regulated to a specified thickness by the layer-thickness regulating blade 13 and then carried on a surface of the developing roller 11 as a thin layer.

The surface of the photosensitive drum 8 is uniformly charged by the scorotron charger 9 along with rotation of the photosensitive drum 8, and then exposed based on image data by an LED unit 10 disposed above the photosensitive drum 8. Thus, a latent image is formed on the surface of the photosensitive drum 8. When the toner carried on the developing roller 11 is supplied to the latent image formed on the surface of the photosensitive drum 8, the latent image is visualized into a toner image or a developer image formed on the surface of the photosensitive drum 8.

Sheets P are accommodated in a sheet tray 18 disposed in the bottom portion of the main body casing 2. The sheets P are singly fed toward the rear upper side by rollers and supplied in between the photosensitive drum 8 and a transfer unit 19, as an example of a transfer member, disposed below and facing the photosensitive drum 8 The transfer unit 19 includes an endless belt 19 and transfer rollers 20. The sheet P is fed between the photosensitive drums 8 and the transfer rollers 20 from the front side to the rear side by the belt 19. At this time, toner images are transferred onto the sheet P.

The sheet P is pressed and heated when passing between the heat roller 21 and the pressure roller 22. At this time, the toner images are fixed onto the sheet P by heat.

Then, the sheet P is fed toward the upper front side and ejected to an ejection tray 23 disposed on the top cover 4.

The process cartridges 5 will be described.

In the following description, a side where the photosensitive drum 8 is disposed is referred to as the rear side of the process cartridge 5, and a side where the scorotron charger 9 is disposed is referred to as the upper side of the process cartridge 5. In other words, the upper side, lower side, front side and rear side of the process cartridge 5 are different from those of the printer 1. The process cartridge 5 is mounted in the printer 1 such that the front side of the process cartridge 5 agrees with the upper front side of the printer 1, the rear side of the process cartridge 5 agrees with the lower rear side of the printer 1, the upper side of the process cartridge 5 agrees with the upper rear side of the printer 1, and the lower side of the process cartridge 5 agrees with the lower front side of the printer 1.

Figure 2:
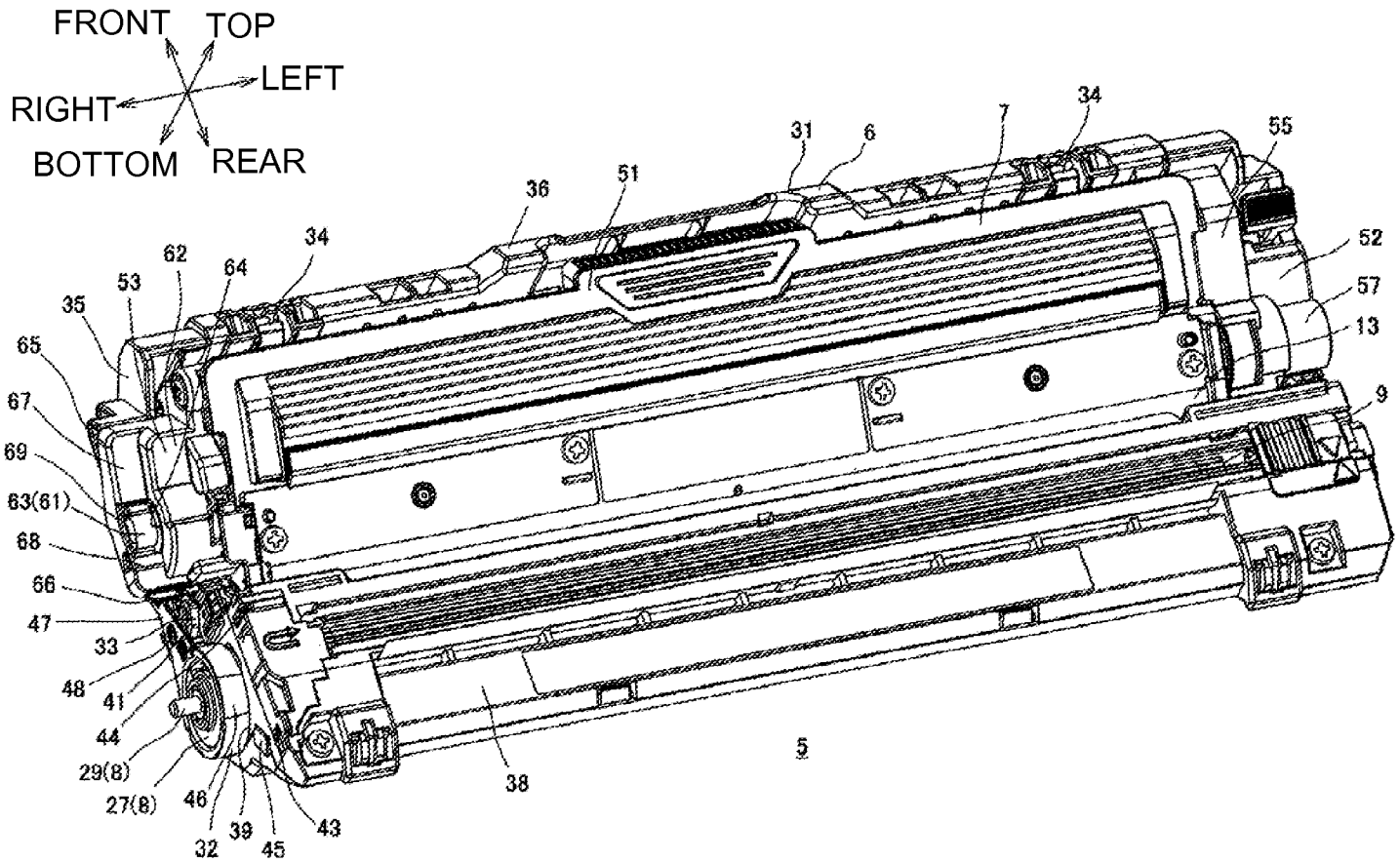
FIG. 2 is a perspective view of a process cartridge shown in FIG. 1.

As shown in FIGS. 2 and 3, the drum cartridge 6 includes a drum frame 31, the photosensitive drum 8, a bearing member 32 as an example of an engaging portion, a contact/separation member 33, and a pressing member 34.

The drum frame 31 is substantially rectangular shape in a plan view. The drum frame 31 includes left and right sidewalls 35, a front wall 36, a lower wall 37, and an upper wall 38.

The left and right sidewalls 35 are spaced apart from each other in the left-right direction and facing each other. The sidewalls 35 are substantially rectangular-shaped in a side view. The sidewalls 35 each have an engagement hole 39, an exposure groove 40, and a separation member supporting boss 41.

The engagement hole 39 is formed at the rear side of the sidewall 35. The engagement hole 39 is formed through the side wall 35 in the left-right direction and substantially circular shaped in a side view. The inside diameter of the engagement hole 39 is substantially equal to the outer diameter of a bearing portion 46 of the bearing member 32.

The exposure groove 40 is formed substantially at the center of the sidewall 35 in the front-rear direction and substantially V-shaped in a side view, which is open upward.

The separation member supporting boss 41 disposed at the front side of the engagement hole 39 and the rear side of the exposure groove 40. The separation member supporting boss 41 is substantially cylindrically shaped and extends outward from the outer surface of the sidewall 35 in the left-right direction.

The right sidewall 35 supports a grid electrode 43, a wire electrode 44 as an example of a cartridge-side electrode, and a cleaner electrode 45.

The grid electrode 43 is disposed on the upper rear side of the engagement hole 39 at the rear end portion of the right sidewall 35. The grid electrode 43 extends vertically and is electrically connected to the grid 24.

The wire electrode 44 is disposed on the front side of the grid electrode 43 above the engagement hole 39. The electrode 44 extends vertically and is electrically connected to the wire 25.

The cleaner electrode 45 is disposed below the grid electrode 43 on the rear side of the engagement hole 39. The cleaner electrode 45 is made of an electrically conductive resin material, and is substantially rectangular-shaped in a side view.

The front wall 36 extends between front end portions of the left and right sidewalls 35. The front wall 36 has a generally flat plate shape extending in the front-rear direction and the left-right direction.

The lower wall 37 extends between the lower end portions of the left and right sidewalls 35. The lower wall 37 has a generally flat plate shape extending in the front-rear direction and the left-right direction and its front end portion is continuous with the lower end portion of the front wall 36.

The upper wall 38 extends between the rear upper end portions of the left and right sidewalls 35. The upper wall 38 has a generally flat plate shape extending in the front-rear direction and the left-right direction and is disposed so as to cover the photosensitive drum 8 from above. The upper wall 38 supports the scorotron charger 9.

Figure 11:
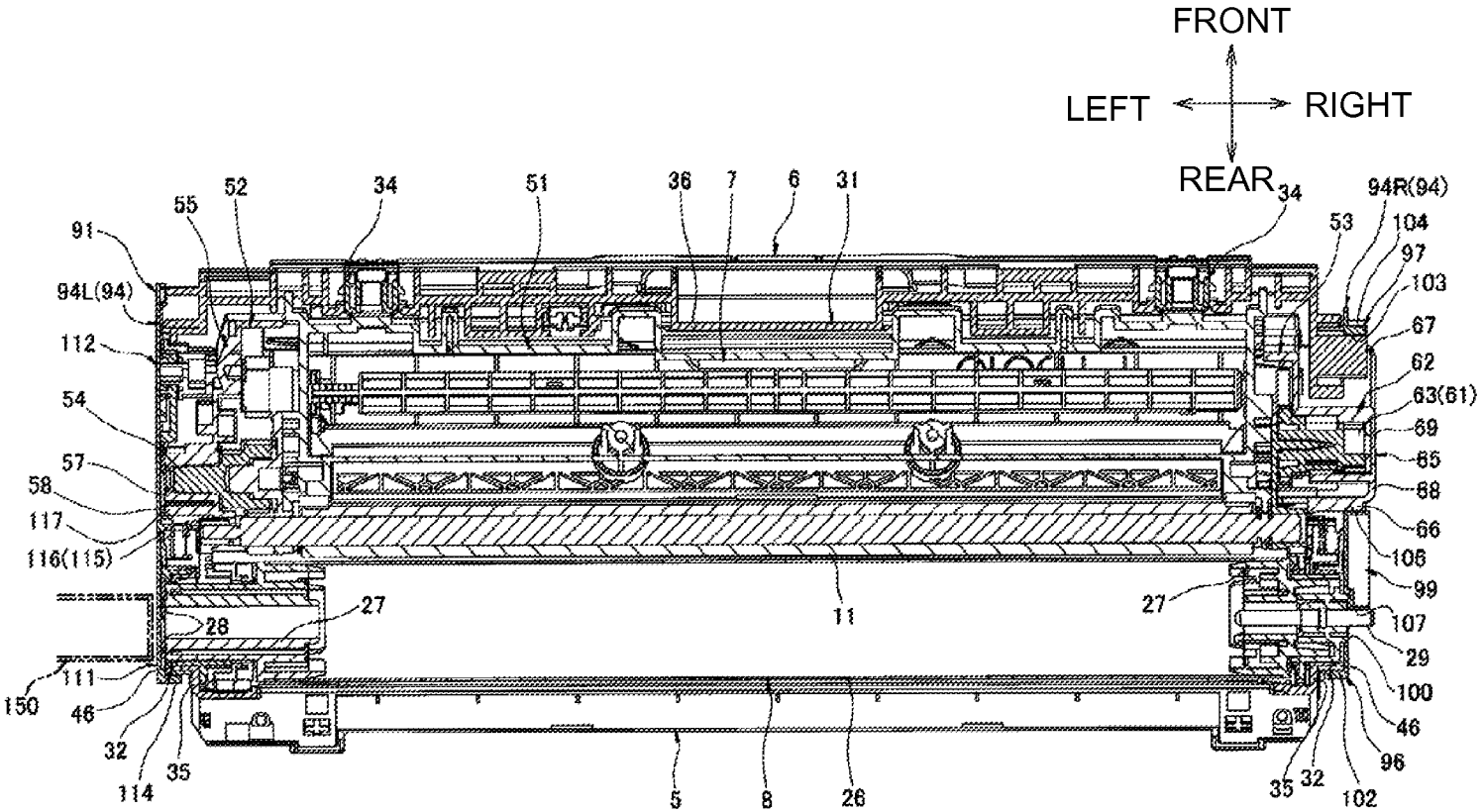
FIG. 11 is a sectional view of the process cartridge taken along the arrowed line A-A of FIG. 10A.

The photosensitive drum 8 is disposed within the rear end portion of the drum frame 31. As shown in FIGS. 11 and 14, the photosensitive drum 8 includes a drum body 26 and left and right flange members 27.

The drum body 26 is made of metal, substantially cylindrically shaped, and elongated in the left-right direction. The outer peripheral surface of the drum body 26 is coated with a resin photosensitive layer.

The left flange member 27 is engaged with the left end portion of the drum body 26 so as not to rotate relative to the drum body 26. The left flange member 27 is substantially cylindrically shaped and elongated in the left-right direction. The left surface of the left flange member 27 is formed with a plurality of, e.g., four, coupling engagement portions 28.

The four coupling engagement portions 28 are disposed along a circumferential edge of the left surface of the left flange member 27 and spaced apart at 90 degrees from each other in a circumferential direction. The coupling engagement portions 28 are recessed portions recessed rightward from the left surface of the left flange member 27 and are substantially rectangular-shaped in a side view. Each coupling engagement portion 28 is configured to receive an end of a corresponding one of main body-side drum couplings 150 as an example of a drive force input member when the process cartridge 5 is mounted in the main body casing 2. The main body-side drum coupling 150 is disposed in the main body casing 2. A drive force is inputted from the main body casing 2 via the main body-side drum couplings 150 to the coupling engagement portions 28. In other words, the left flange member 27 functions as a passive member.

The right flange member 27 is engaged with the right end portion of the drum body 26 so as not to rotate. The right flange member 27 is substantially cylindrically shaped and elongated in the left-right direction. The right flange member 27 supports a shaft 29.

The shaft 29 is substantially cylindrically shaped and elongated in the left-right direction so as to pass through the center of right flange member 27 in the radial direction. The right end portion of the shaft 29 protrudes rightward from the right surface of the right flange member 27.

Figure 3A:
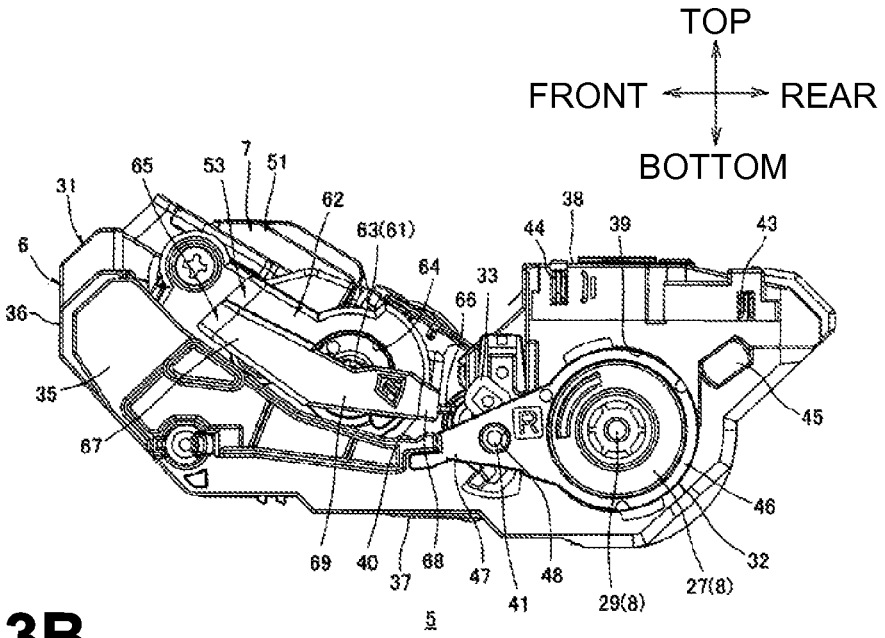
FIG. 3A is a right side view of the process cartridge shown in FIG. 2.
Figure 3B:
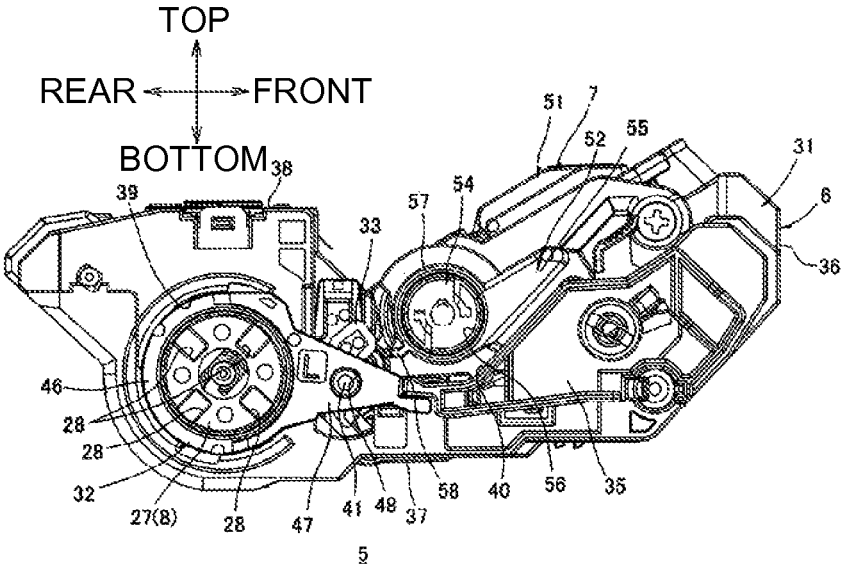
FIG. 3B is a left side view of the process cartridge shown in FIG. 2.

As shown in FIGS. 2, 3A and 3B, the bearing member 32 is supported at the rear end portion of each of the left and right sidewalls 35. The bearing member 32 is substantially cylindrically shaped and elongated in the left-right direction. The bearing member 32 integrally includes a bearing portion 46 and a supporting boss engagement portion 47.

The bearing portion 46 is substantially cylindrically shaped and elongated in the left-right direction. The inside diameter of the bearing portion 46 is substantially equal to the inside diameter of the end of the photosensitive drum 8 in the left-right direction.

The supporting boss engagement portion 47 protrudes frontward from the front end portion of the bearing portion and has a generally flat plate shape having a thickness in the left-right direction. The supporting boss engagement portion 47 has a supporting boss engagement hole 48 formed therethrough.

The supporting boss engagement hole 48 is formed in the center of the supporting boss engagement portion 47 in the front-rear direction and is a long hole in a side view. The vertical length of the supporting boss engagement hole 48 is substantially equal to the outside diameter of the separation member supporting boss 41.

The bearing member 32 fits around the flange member 27 of the photosensitive drum 8 so as to rotate relative to the flange member 27 at the bearing portion 46. In other words, the bearing member 32 engages around the flange member 27 radially from outside and in the engagement hole 39 of the drum frame 31 so as to rotate therein.

The supporting boss engagement hole 48 of the bearing member 32 receives an end of the separation member supporting boss 41 therein.

The separation member 33 is disposed on the front side of the engagement hole 39 and the rear side of the exposure groove 40 on the outer surface of each of the side walls 35 in the left-right direction. The separation member 33 extends vertically. The separation member 33 is substantially V-shaped in a side view and is open toward front side. The separation member 33 has a through hole (not shown) substantially at the center in the vertical direction.

The separation member supporting boss 44 is inserted into the through hole of the separation member 33, and the separation member 33 is rotatably supported by the separation member supporting boss 41.

The pressing member 34 is disposed on both end portions of the front wall 36 of the drum frame 31 in the left-right direction such that the pressing member 34 is slidable in the front-rear direction. The pressing member 34 is shaped like an angular column extending in the front-rear direction. The rear end portion of the pressing member 34 contacts the cartridge frame 51 of the developing cartridge 7 from the front side.

The pressing member 34 has a compression coil spring (not shown) therein. The compression coil spring can be compressed along a sliding direction of the pressing member 34. With the spring, the pressing member 34 is urged to the rear side to press the developing cartridge 7 rearward toward the photosensitive drum 8.

The developing cartridge 7 includes a cartridge frame 51, a drive unit 52, and a power supply unit 53.

The cartridge frame 51 is substantially box-shaped and elongated in the left-right direction. The cartridge frame 51 supports the developing roller 11, the supply roller 12, and the layer thickness regulating blade 13 and contains toner therein.

The drive unit 52 is disposed on the left side of the cartridge frame 51. The drive unit 52 includes a developing coupling 54 and a drive-side cover 55.

The developing coupling 54 is substantially cylindrically shaped and elongated in the left-right direction. The developing coupling 54 is rotatably accommodated in the drive-side cover 55. The left surface of the developing coupling 54 is formed with a coupling recessed portion 56.

The coupling recessed portion 56 is recessed rightward from the left surface of the developing coupling 54, extends in the radial direction of the developing coupling 54, and is substantially circular shaped in a side view. The coupling recessed portion 56 is configured to receive the end of the main body-side developing coupling 151 (FIG. 5) disposed in the main body casing 2 when the developing cartridge 7 is mounted in the main body casing 2. Rotation drive force is inputted from the main body casing 2 via the main body-side developing coupling 151 to the developing coupling 54. The rotation drive force inputted to the developing coupling 54 is transmitted via gear train (not shown) to the developing roller 11 and the supply roller 12.

The drive-side cover 55 extends in the left-right direction and is closed at its left end.

The drive-side cover 55 includes a coupling collar 57 and a separation engagement portion 58.

The coupling collar 57 is substantially cylindrical shape and protrudes leftward from the left side of the drive-side cover 55 substantially at the center thereof in the front-rear direction. The right end portion of the coupling collar 57 communicates with the inside of the drive-side cover 55.

The separation engagement portion 58 protrudes rearward from the rear end portion of the coupling collar 57 and is shaped like a ridge extending in the left-right direction.

The drive-side cover 55 is screwed to the left wall of the cartridge frame 51 such that the left end portion of the developing coupling 54 is engaged in the coupling collar 57. The coupling recessed portion 56 is exposed from the left end portion of the coupling collar 57.

The power supply unit 53 is disposed on the right side of the cartridge frame 51. The power supply unit 53 includes an electrode member 61 and a power supply-side cover 62.

The electrode member 61 is made of an electrically conductive resin material such as an electrically conductive polyacetal resin, and supported by the right wall of the cartridge frame 51 inside the power supply-side cover 62. The electrode member 61 includes a power receiving portion 63.

The power receiving portion 63 is substantially cylindrically shaped and extends in the left-right direction.

The electrode member 61 includes, on the rear side of the power receiving portion 63, a developing roller supporting portion 70 (FIG. 16) configured to rotatably support a metal shaft 60 (FIG. 16) of the developing roller 11. The electrode member 61 further includes, on the lower rear side of the power receiving portion 63, a supply roller supporting portion (not shown) configured to rotatably support a metal shaft of the supply roller 12.

The power supply-side cover 62 extends in the left-right direction and is closed at its right end portion. The power supply-side cover 62 has a power receiving portion exposure opening 64, a power receiving portion protection portion 65, and a separation engagement portion 66.

The power receiving portion exposure opening 64 is formed through the right wall of the power supply-side cover 62 substantially at the center thereof such that the right end portion of the power receiving portion 63 is exposed. The power receiving portion exposure opening 64 is substantially circular shaped in a side view.

The power receiving portion protection portion 65 integrally includes a front-side protection portion 67, a rear-side protection portion 68, and a right-side protection portion 69.

The front-side protection portion 67 protrudes rightward from a front-side peripheral edge defining the power receiving portion exposure opening 64.

The rear-side protection portion 68 protrudes rightward from a rear-side peripheral edge defining the power receiving portion exposure opening 64.

The right-side protection portion 69 has a generally flat plate shape and extends in the front-rear direction such that the right-side protection portion 69 extends between the right end portion of the front-side protection portion 67 and the right end portion of the rear-side protection portion 68. The right-side protection portion 69 faces the right end portion of the power receiving portion 63 from the right side.

The separation engagement portion 66 protrudes rearward from the rear end portion of the power supply-side cover 62 and is shaped like a ridge extending in the left-right direction.

The power supply-side cover 62 is screwed to the right sidewall 35 such that the right end portion of the power receiving portion 63 is exposed from the opening 64 between the front-side protection portion 67 and the rear-side protection portion 68.

The main body casing 2 will be described.

Figure 12:
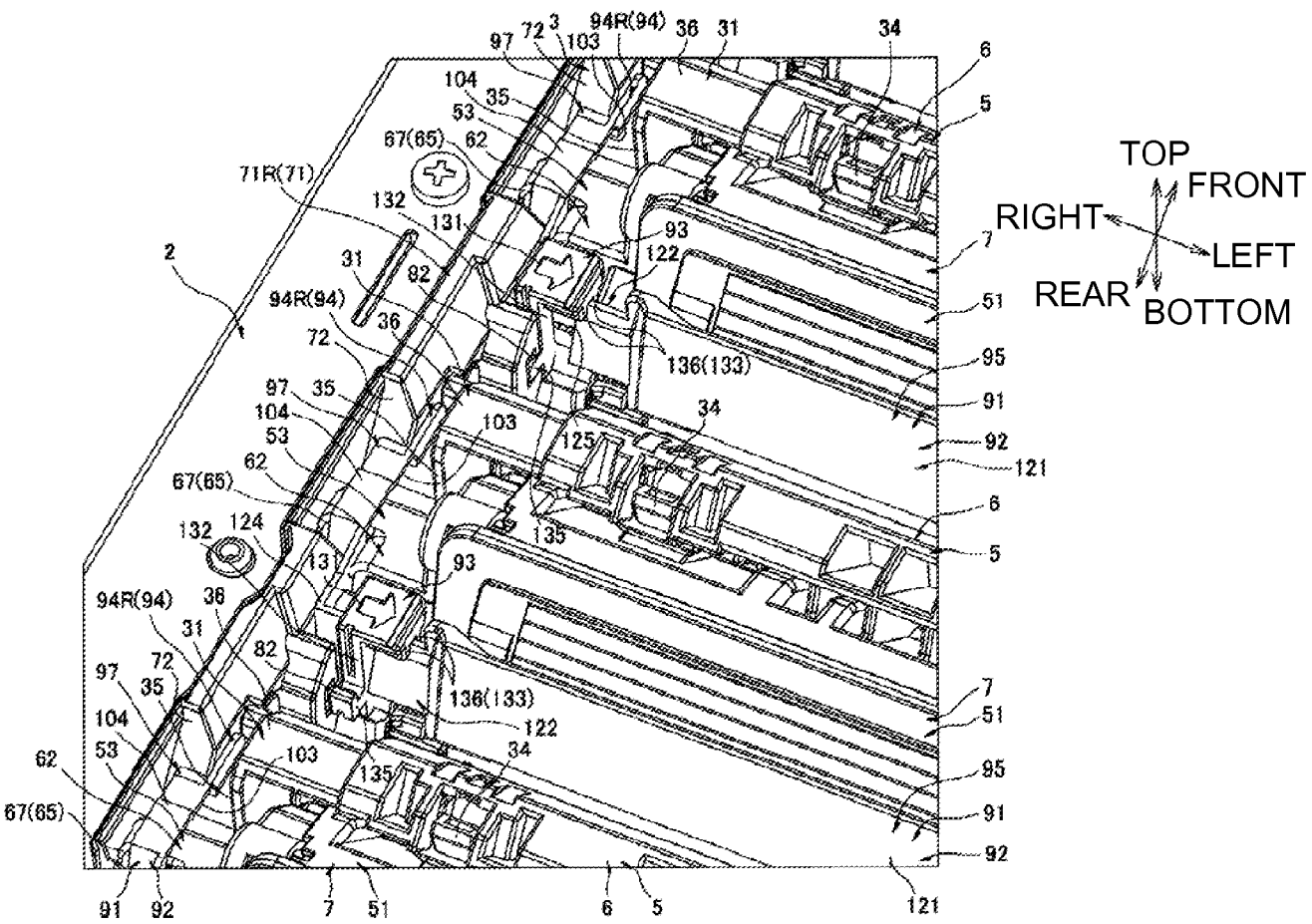
FIG. 12 is an enlarged perspective view illustrating that a right end portion of the process cartridge is fixed to the right sidewall of the main body casing.
Figure 13:
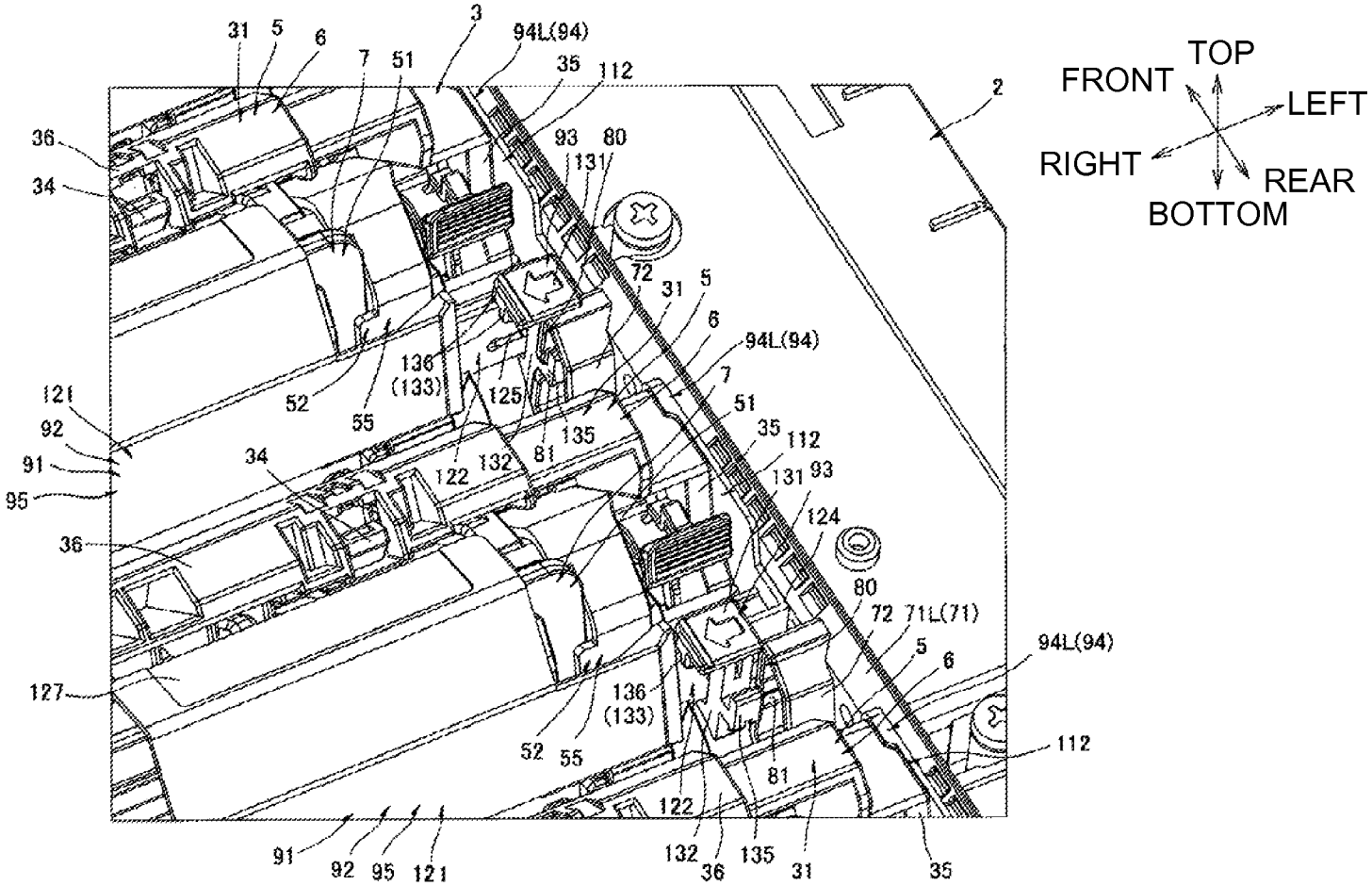
FIG. 13 is an enlarged perspective view illustrating that a left end portion of the process cartridge is fixed to the left sidewall of the main body casing.

As shown in FIGS. 12 and 13, the main body casing 2 includes left and right main body sidewalls 71 as an example of first and second frames.

The left and right main body sidewalls 71 are spaced apart from each other in the left-right direction such that the process cartridges 5 are sandwiched from outside in the left-right direction between the main body sidewalls 71. The main body sidewalls 71 have a generally flat plate shape extending in the front-rear direction and the top-bottom direction. In the following description, the right side main body sidewall 71 is referred to as a main body right wall 71R and the left-side main body sidewall 71 is referred to as a main body left wall 71L.

Figure 4:
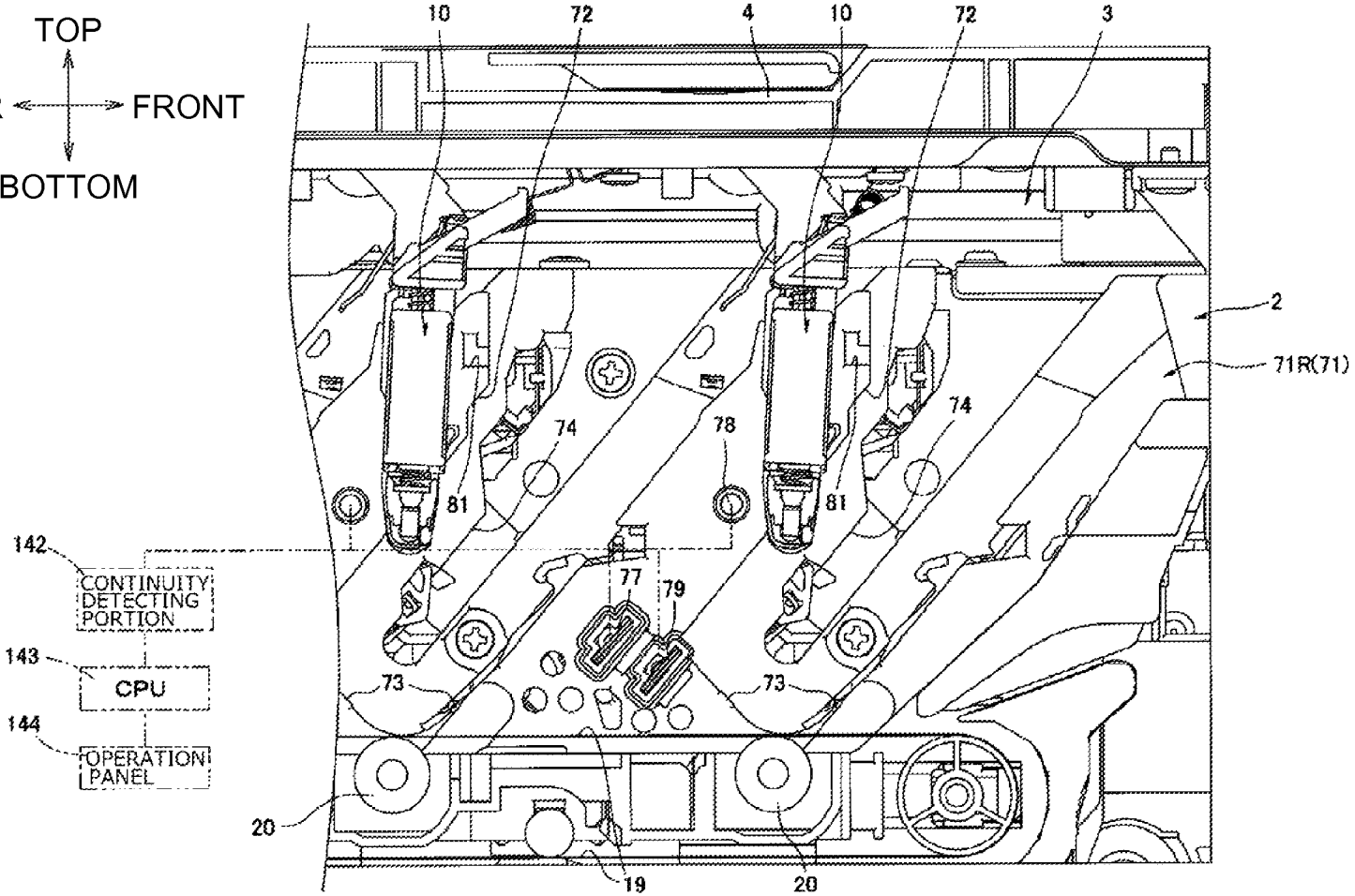
FIG. 4 is an enlarged view of a right sidewall of a main body casing shown in FIG. 1.
Figure 5:
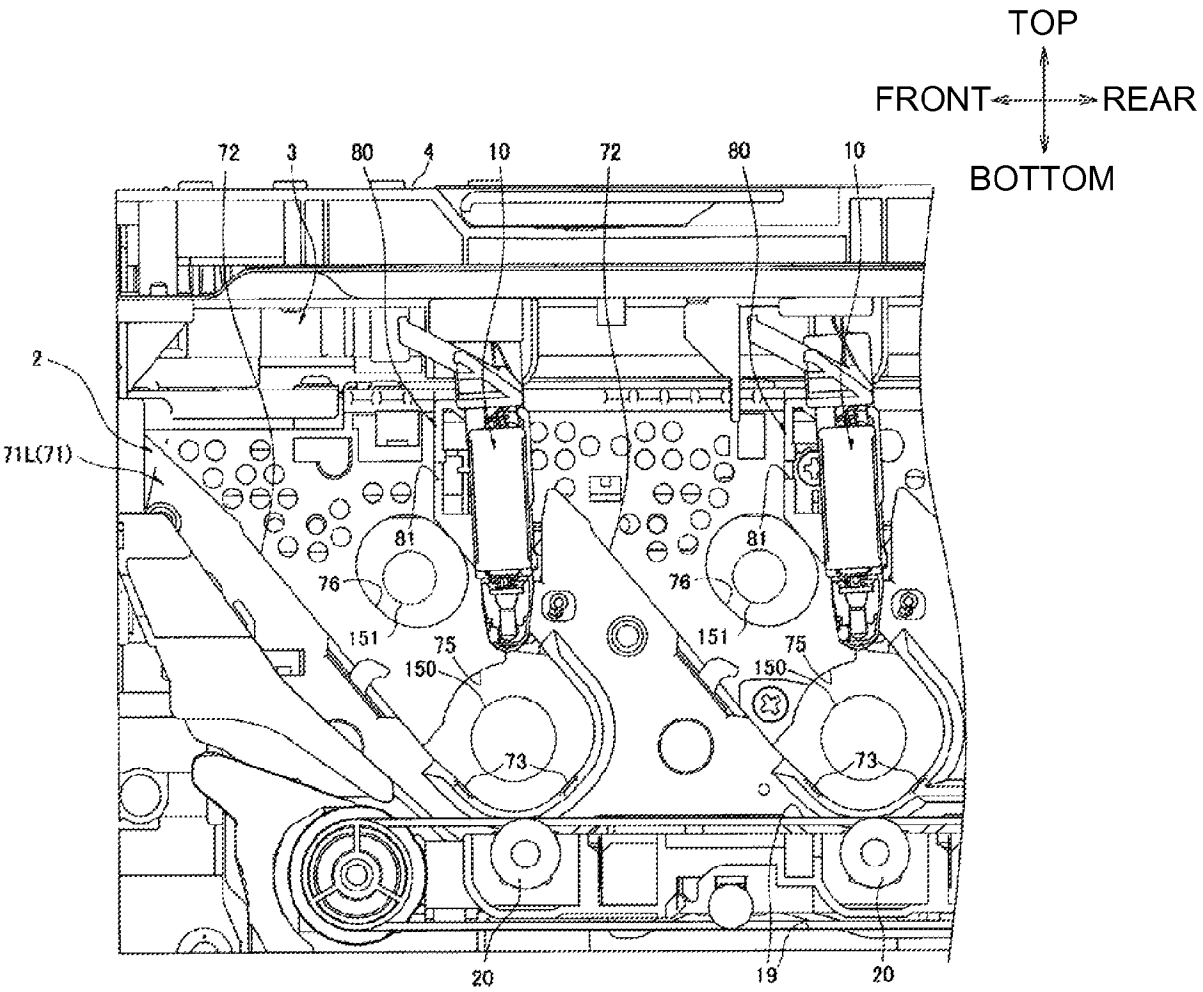
FIG. 5 is an enlarged view of a left sidewall of a main body casing shown in FIG. 1.

As shown in FIGS. 4 and 5, the main body sidewalls 71 have a plurality of, e.g., four, cartridge guide grooves 72 formed therein.

The four cartridge guide grooves 72 are formed on the inner surface of each of the main body sidewalls 71 and are arranged parallel to one another and spaced at regular intervals in the front-rear direction in one-to-one correspondence with the process cartridges 5. Each of the cartridge guide grooves 72 slopes in a direction connecting the upper front side and the lower rear side from the upper portion of each main body sidewall 71, is substantially U-shaped in a side view and is open at the upper front end portion. The width of the cartridge guide groove 72 or the length thereof in the direction connecting the lower front side and the upper rear side is larger than the outside diameter of bearing portion 46 of the process cartridge 5. The lower end portion of the cartridge guide groove 72 is substantially level with the upper surface of the belt 19 in a side view. A pair of positioning protrusions 73, as an example of a positioning portion, protrude inside the cartridge guide groove 72. The positioning protrusions 73 are configured to position the process cartridge 5 in an image formation position.

The positioning protrusions 73 are spaced apart from each other in the front-rear direction in the lower end portion of the cartridge guide groove 72. The front-side positioning protrusion 73 has a substantially rectangular shape in a side view and protrudes slightly from the lower front side of the inner surface of the cartridge guide groove 72 toward the upper rear side. The rear-side positioning protrusion 73 has a substantially rectangular shape in a side view and protrudes slightly from the lower rear side of the inner surface of the cartridge guide groove 72 toward the upper front side.

As shown in FIGS. 4 and 12, the main body right wall 71R has shaft engagement grooves 74 and packing member locking grooves 82 as an example of a fixing portion, which are provided in one-to-one correspondence with the process cartridges 5. The main body right wall 71R supports main body-side grid electrodes 77 as an example of a main body-side electrode, main body-side wire electrodes 78, and main body-side cleaner electrodes 79, which are provided in one-to-one correspondence with the process cartridges 5.

Each of the shaft engagement grooves 74 is disposed in the center of the corresponding cartridge guide groove 72 in the width direction thereof. The shaft engagement groove 74 slopes in the direction connecting the upper front side and the lower rear side, is generally U-shaped in a side view and is open at the upper front end portion. The width of the shaft engagement groove 74 or the length thereof in the direction connecting the lower front side and the upper rear side is larger than the outside diameter of shaft 29 of the process cartridge 5. The lower end portion of the shaft engagement groove 74 is spaced apart from the front-side positioning protrusion 73 to the upper rear side and spaced apart from the rear-side positioning protrusion 73 to the upper front side. The lower end portion of the shaft engagement groove 74 is spaced substantially evenly apart from the front-side and rear-side positioning protrusions 73.

Each packing member locking groove 82 is disposed on the rear side of the upper portion of the corresponding cartridge guide groove 72. The packing member locking groove 82 has a hook-like shape in a side view, which extends in the front-rear direction and is bent upward at its rear end portion. The front end portion of the packing member locking groove 82 communicates with the cartridge guide groove 72.

Each main body-side grid electrode 77 is disposed on the rear side of the lower end portion of the cartridge guide groove 72. The main body-side grid electrode 77 is substantially annularly shaped and is supported by the main body right wall 71R such that its radial end portion protrudes leftward from the left surface of the main body right wall 71R. The main body-side grid electrode 77 is electrically connected to a power supply board (not shown) disposed in the main body casing 2.

Each main body-side wire electrode 78 is disposed on the rear side of the center of the cartridge guide groove 72 in the top-bottom direction. The main body-side wire electrode 78 substantially cylindrically shaped and extends in the left-right direction. The main body-side wire electrode 78 is supported by the main body right wall 71R such that its left end portion protrudes leftward from the left surface of the main body right wall 71R. The main body-side wire electrode 78 is electrically connected to the power supply board (not shown) disposed in the main body casing 2.

Each main body-side cleaner electrode 79 is disposed on the rear front side of the main body-side grid electrode 77 on the rear side of lower end portion of the cartridge guide groove 72. The main body-side cleaner electrode 79 is substantially annularly shaped and is supported by the main body right wall 71R such that its end portion protrudes leftward from the left surface of the main body right wall 71R. The main body-side cleaner electrode 79 is electrically connected to the power supply board (not shown) disposed in the main body casing 2.

As shown in FIGS. 5 and 13, the main body left wall 71L has drum coupling exposure holes 75, main body-side developing coupling exposure holes 76, and packing member locking ribs 80 as an example of a fixing portion, which are provided in one-to-one correspondence with the process cartridges 5.

Each drum coupling exposure hole 75 is disposed in the lower end portion of the cartridge guide groove 72. The drum coupling exposure hole 75 is substantially circular shaped. The diameter of the drum coupling exposure hole 75 is larger than the outside diameter of the left end portion of the left flange member 27 of the photosensitive drum 8.

The main body-side developing coupling exposure hole 76 is spaced apart from the drum coupling exposure hole 75 to the upper front side. The main body-side developing coupling exposure hole 76 is formed through the left wall of the cartridge guide groove 72 and has the shape of substantially a long hole in a side view. The main body-side developing coupling 151 is disposed in the main body-side developing coupling exposure hole 76.

Each packing member locking rib 80 is disposed on the rear side of the upper end portion of the cartridge guide groove 72 and constitutes the rear wall defining the upper end portion of the cartridge guide groove 72. The packing member locking rib 80 is shaped like a ridge extending in the top-bottom direction. The packing member locking rib 80 has an engagement groove 81 formed therein.

The engagement groove 81 is disposed substantially at the center of the packing member locking rib 80 in the top-bottom direction. The engagement groove 81 is recessed leftward from the right end portion of the packing member locking rib 80 and passes therethrough in the front-rear direction.

As shown in FIG. 4, the main body casing 2 includes a continuity detecting portion 142, a CPU 143, and an operation panel 144 as an information portion.

The continuity detecting portion 142 is electrically connected to the main body-side grid electrodes 77, the main body-side wire electrodes 78, the main body-side cleaner electrodes 79 and the CPU 143. The continuity detecting portion 142 is configured to detect electrical continuity between the main body-side grid electrode 77 and the grid electrode 43, and between the main body-side wire electrode 78 and the wire electrode 44, and between the main body-side cleaner electrode 79 and the cleaner electrode 45. The continuity detecting portion 142 is configured to send a detection signal to the CPU 143 based on the detection of the electrical continuity therebetween.

The CPU 143 is configured to control the operations of the printer 1 in accordance with specified programs. The CPU 143 is electrically connected to the operation panel 144.

The operation panel 144 is disposed at the front end portion of the main body casing 2 such that it is exposed to the front side as shown in FIG. 1. The operation panel 144 is controlled by the CPU 143 to display messages.

In this embodiment, when the printer 1 is packed in a carton prior to shipment, all process cartridges 5 wrapped with packing members 91, as an example of a separation member, are accommodated in the main body casing 2 as shown in FIGS. 12 and 13. The following will describe how the process cartridges 5 are accommodate in the main body casing 2 using the packing members 91.

Figure 6:
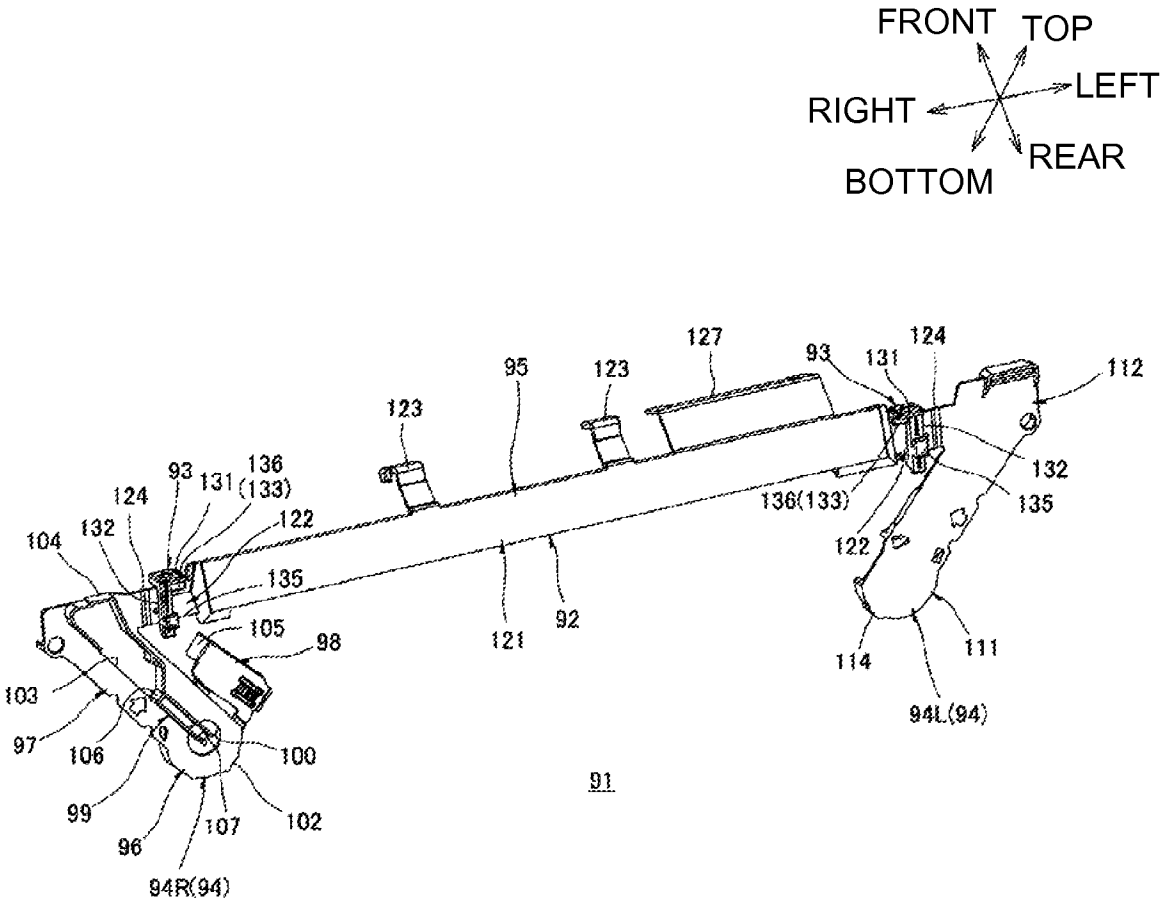
FIG. 6 is a perspective view of a packing member to be attached to the process cartridge shown in FIG. 2.
Figure 7:
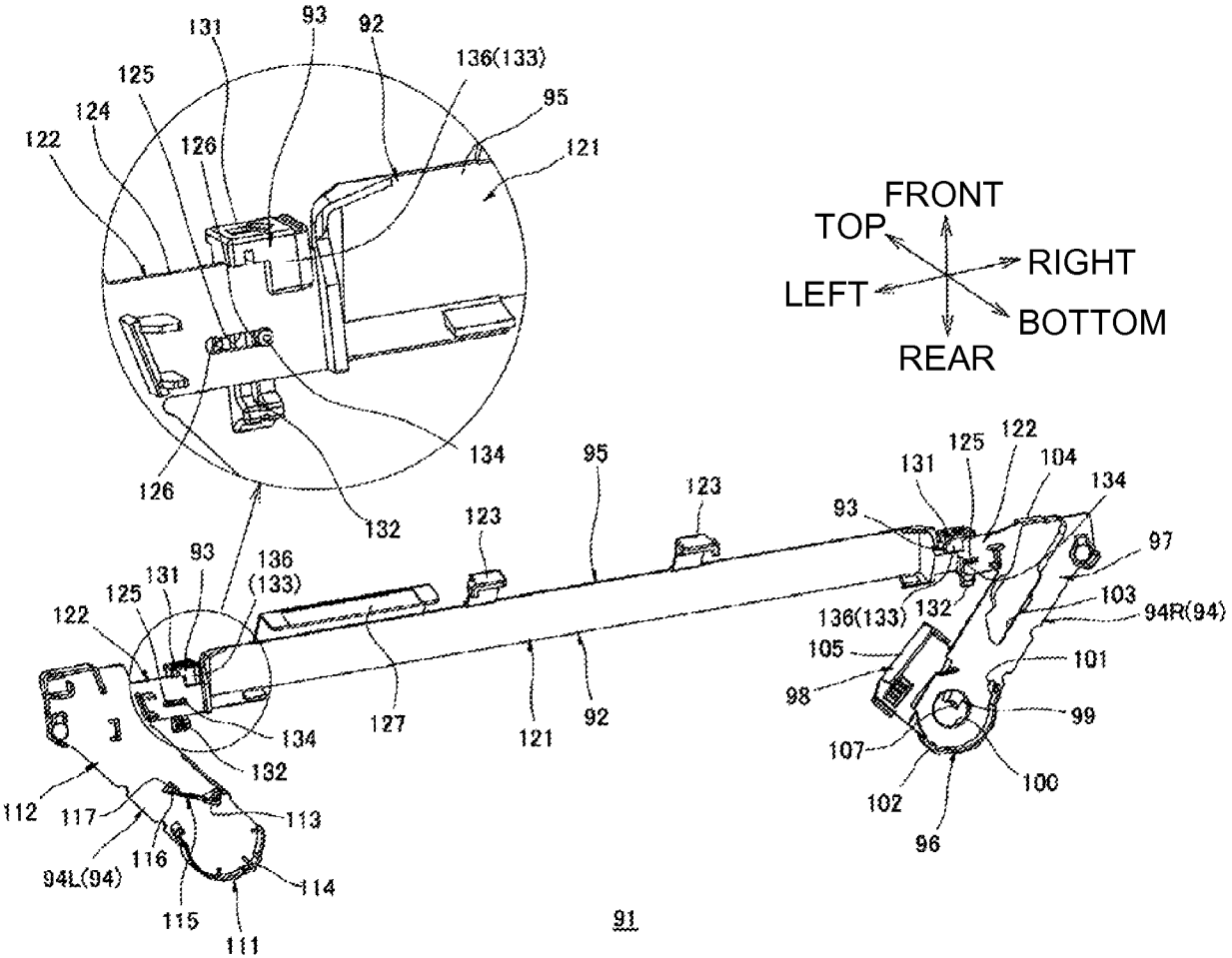
FIG. 7 is a perspective view of the packing member shown in FIG. 6.

The packing members 91 are parts used in packing and made of an insulating resin material. As shown in FIGS. 6 and 7, a packing member 91 includes a packing member main body 92 and left and right fixing members 93 as an example of a fixing portion. In the following description, the directions of the packing member 91 are identified with those used in the description of the process cartridge 5.

The packing member main body 92 has substantially a flat band shape, extends in the left-right direction and is bent at its left and right end portions to the rear side. More specifically, the packing member main body 92 integrally includes left and right covering portions 94 as an example of a first portion and a second portion and a connecting portion 95 as an example of a third portion. In the following description, a right covering portion 94 is referred to as 94R and a left covering portion 94 is referred to as 94L.

The right covering portion 94R is disposed at the right end portion of the packing member main body 92. The right covering portion 94R has a flat plate shape that is substantially rectangular, in a plan view, extending toward the rear side such that it is inclined to the left side. The right covering portion 94R includes a bearing member engagement portion 96, a power supply unit engagement portion 97, a wire electrode covering portion 98 as an example of an insulating portion, and a separation portion as an example of a developer carrier separation portion.

The bearing member engagement portion 96 is substantially cylindrically shaped. The bearing member engagement portion 96 has a shaft exposure opening 100 and an engagement portion receiving groove 101. The bearing member engagement portion 96 also includes a protrusion 102 as an example of a spacer portion.

The shaft exposure opening 100 is disposed in the center of the bearing member engagement portion 96 in its radial direction and substantially circular shaped in a plan view.

The engagement portion receiving groove 101 is recessed in the top-bottom direction along the front upper side peripheral wall of the bearing member engagement portion 96.

The protrusion 102 is substantially rectangular shaped in a plan view such that the protrusion 102 protrudes from the rear left side peripheral wall of the bearing member engagement portion 96 to the rear left side.

The power supply unit engagement portion 97 has a flat plate shape that is substantially rectangular in a plan view extending to the front upper side from the front right end portion of the upper wall of the bearing member engagement portion 96. The power supply unit engagement portion 97 has a power supply unit engagement hole 103. The power supply unit engagement portion 97 includes a reinforcing rib 104.

The power supply unit engagement hole 103 has substantially a rectangular shape, which extends to the front right side and the rear left side. The power supply unit engagement hole 103 has a length, in a direction connecting the front right side and the rear left side, longer than the length, in the front-rear direction, of the power receiving portion protection portion 65 of the developing cartridge 7. The power supply unit engagement hole 103 has a length, in the direction connecting the front left side and the rear right side, longer than the length, in the top-bottom direction, of the power receiving portion protection portion 65 of the developing cartridge 7.

The reinforcing rib 104 is shaped like a ridge extending upward from the upper surface of the power supply unit engagement portion 97 and along the peripheral edge portion of the power supply unit engagement hole 103.

The wire electrode covering portion 98 has a flat plate shape that is substantially rectangular in a plan view extending continuously from the front left side end portion of the upper wall of the bearing member engagement portion 96 to the front left side. The wire electrode covering portion 98 includes a reinforcing wall 105.

The reinforcing wall 105 protrudes from the lower surface of the wire electrode covering portion 98 to the lower side, and is substantially L-shaped, in a bottom plan view, in configuration having the front left side end and the front right end of the wire electrode covering portion 98.

A separation portion 99 is disposed on the left rear side of the power supply unit engagement hole 103. The separation portion 99 is substantially box-shaped, protruding upward from the upper surface of the right covering portion 94R and extending to the front right side and the rear left side. The front end portion of the separation portion 99 is disposed at the rear left side peripheral end defining the power supply unit engagement hole 103. The rear end portion of the separation portion 99 protrudes toward the shaft exposure opening 100 and is disposed such that it overlaps the center of the shaft exposure opening 100 in a plan view. The front surface 106 of the separation portion 99 is flat and extends toward the front left side and the rear right side. The rear surface 107 of the separation portion 99 is substantially arc-shaped.

The left covering portion 94L is disposed at the left end portion of the packing member main body 92. The left covering portion 94L has a flat plate shape that is substantially rectangular, in a plan view, extending toward the rear side such that it is inclined to the right side. The left covering portion 94L includes a bearing member engagement portion 111 as an example of an interruption member, and a drive unit covering portion 112.

The bearing member engagement portion 111 is substantially cylindrically shaped. The bearing member engagement portion 111 has an engagement portion receiving groove 113. The bearing member engagement portion 111 also includes a protrusion 114 as an example of a spacer portion.

The engagement portion receiving groove 113 is recessed in the top-bottom direction along the front left side peripheral wall of the bearing member engagement portion 111.

The protrusion 114 is substantially rectangular shaped in a plan view such that the protrusion 114 protrudes from the rear right side peripheral wall of the bearing member engagement portion 111 to the rear right side.

The drive unit covering portion 112 has a flat plate shape that is substantially rectangular in a plan view extending continuously from the front left side end portion of the upper wall of the bearing member engagement portion 111 to the front left side. The drive unit covering portion 112 includes a separation rib 115 as an example of a developer carrier separation portion.

The separation rib 115 is disposed on the rear side of the bearing member engagement portion 111. The separation rib 115 is shaped like a ridge protruding downward from the lower surface of the drive unit covering portion 112 and extending continuously from the right side peripheral end portion of the engagement portion receiving groove 113. The separation rib 115 includes a contact portion 116.

The contact portion 116 is disposed at the front end portion of the separation rib 115. The contact portion 116 substantially rectangular-shaped in a bottom plan view, and its front surface 117 is flat and extends toward the front right side and the rear left side.

The connecting portion 95 is disposed between the left and right covering portions 94. The connecting portion 95 has a generally flat plate shape extending in the left-right direction. The right end portion of the connecting portion 95 is connected to the front end portion of the right covering portion 94R and the left end portion of the connecting portion 95 is connected to the front end portion of the left covering portion 94L. The connecting portion 95 integrally includes a connecting portion main body 121 and left and right fixing member supporting portions 122 as an example of a portion connected to the first or second portion.

The connecting portion main body 121 comprises the most part of the connecting portion 95 in the center in the left-right direction, and has substantially a flat plate shape extending in the left-right direction. The connecting portion main body 121 includes a plurality of, e.g., two, developing cartridge engagement portions 123 as an example of a plurality of first restraining portions, and a protrusion 127 as an example of an information portion.

The developing cartridge engagement portions 123 are spaced apart from each other in the left-right direction and disposed parallel to each other at the central front end portion of the connecting portion main body 121 in the left-right direction. The developing cartridge engagement portions 123 extend frontward from the front end of the connecting portion main body 121 and are bent downward at their front end portions. The developing cartridge engagement portions 123 have substantially a flat plate shape in a plan view.

The protrusion 127 is disposed at the left end portion of the connecting portion main body 121. The protrusion 127 extends frontward from the front end of the connecting portion main body 121 and is bent downward at its front end portion. The protrusion 127 has a wide width in the left-right direction. The protrusion 127 has information on it, which, for example, indicates a user to remove the packing member 91 before first use.

The left and right fixing member supporting portions 122 are disposed at the left and right end portions of the connecting portions 95 respectively. The right fixing member supporting portion 122 has substantially a flat plate shape, extending continuously rightward from the right end portion of the connecting portion main body 121. The right end portion of the right fixing member supporting portion 122 is connected to the front end portion of the right covering portion 94R. The left fixing member supporting portion 122 has substantially a flat plate shape, extending continuously leftward from the left end portion of the connecting portion main body 121. The left end portion of the left fixing member supporting portion 122 is connected to the front end portion of the left covering portion 94L.

Each of the fixing member supporting portions 122 has a bending portion 124 and a guide groove 125.

The bending portion 124 is disposed on an outer end of the fixing member supporting portion 122 in the left-right direction, and extends along the outer end of the fixing member supporting portion 122 in the front-rear direction. The bending portion 124 has a notch recessed downward from the upper surface of the fixing member supporting portion 122, and is thin in the top-bottom direction.

The guide groove 125 is disposed substantially at the center of the fixing member supporting portion 122 in the left-right direction on the inside of the bending portion 124. The guide groove 125 is shaped like a long hole elongated in the left-right direction. The length of the guide groove 125 in the front-rear direction is substantially equal to the outside diameter of an engagement boss 134 of the fixing member 93. The guide groove 125 has an aperture portion 126.

The aperture portion 126 is disposed on each end of the guide groove 125 in the left-right direction. The aperture portion 126 becomes constricted such that its length is slightly narrower in the front-rear direction.

The left and right fixing members 93 are supported by the left and right fixing member supporting portions 122 of the connecting portion 95, respectively. Each fixing member 93 is substantially box-shaped and extends in the front-rear direction. The fixing member 93 integrally includes an operation portion 131 and an engagement arm 132.

The operation portion 131 is disposed at the front end portion of the fixing member 93. The operation portion 131 has substantially a flat plate shape extending in the top-bottom direction. The operation portion 131 includes a clip portion 133.

The clip portion 133 is disposed on the rear side of the lower end portion of the operation portion 131. The clip portion 133 includes upper and lower protrusions 136.

The upper and lower protrusions 136 are spaced apart from each other in the top-bottom direction. Specifically, the upper protrusion 136 protrudes rearward from the operation portion 131 in the top-bottom direction, and has substantially a flat plate shape that is substantially rectangular, in a plan view, extending in the left-right direction. The lower protrusion 136 protrudes rearward from the operation portion 131, and has substantially a flat plate shape that is substantially rectangular, in a plan view. The distance between the upper and lower protrusions 136 is substantially equal to the thickness of the fixing member supporting portion 122 of the connecting portion 95.

The engagement arm 132 is disposed on the outer side of the upper end portion of the operation portion 131 in the left-right direction. The engagement arm 132 has substantially a rectangular prism shape extending from the rear surface of the operation portion 131 to the rear side. The length of the engagement arm 132 in the front-rear direction is larger than the length of the fixing member supporting portion 122 of the connecting portion in the front-rear direction. The engagement arm 132 includes an engagement boss 134 and an engagement protrusion 135.

The engagement boss 134 is substantially cylindrically shaped such shat it protrudes downward from the lower surface of the engagement arm 132 substantially at the center thereof in the front-rear direction.

The engagement protrusion 135 is substantially hook shaped such that it protrudes upward from the upper surface of the engagement arm 132 substantially at the center thereof in the front-rear direction, and its upper end portion is bent frontward.

The fixing member 93 is supported by the fixing member supporting portion 122 such that the front end portion of the fixing member supporting portion 122 is sandwiched between the upper and lower protrusions 136 and the engagement boss 134 engages in the guide groove 125.

With this structure, the fixing member 93 is movable, e.g., slidable, in the left-right direction between a release position where the engagement boss 134 is located at the inner side in the guide groove 125 in the left-right direction and a fix position where the engagement boss 134 is located at the outer side in the guide groove 125 in the left-right direction. The release position is the position of the fixing member 93 shown in FIG. 6 and the fix position is the position of the fixing member 93 shown in FIG. 8.

The following will describe that the packing member 91 is attached to the process cartridge.

Before the process cartridge 5 is accommodated in the main body casing 2, it is wrapped with the packing member 91.

Figure 8:
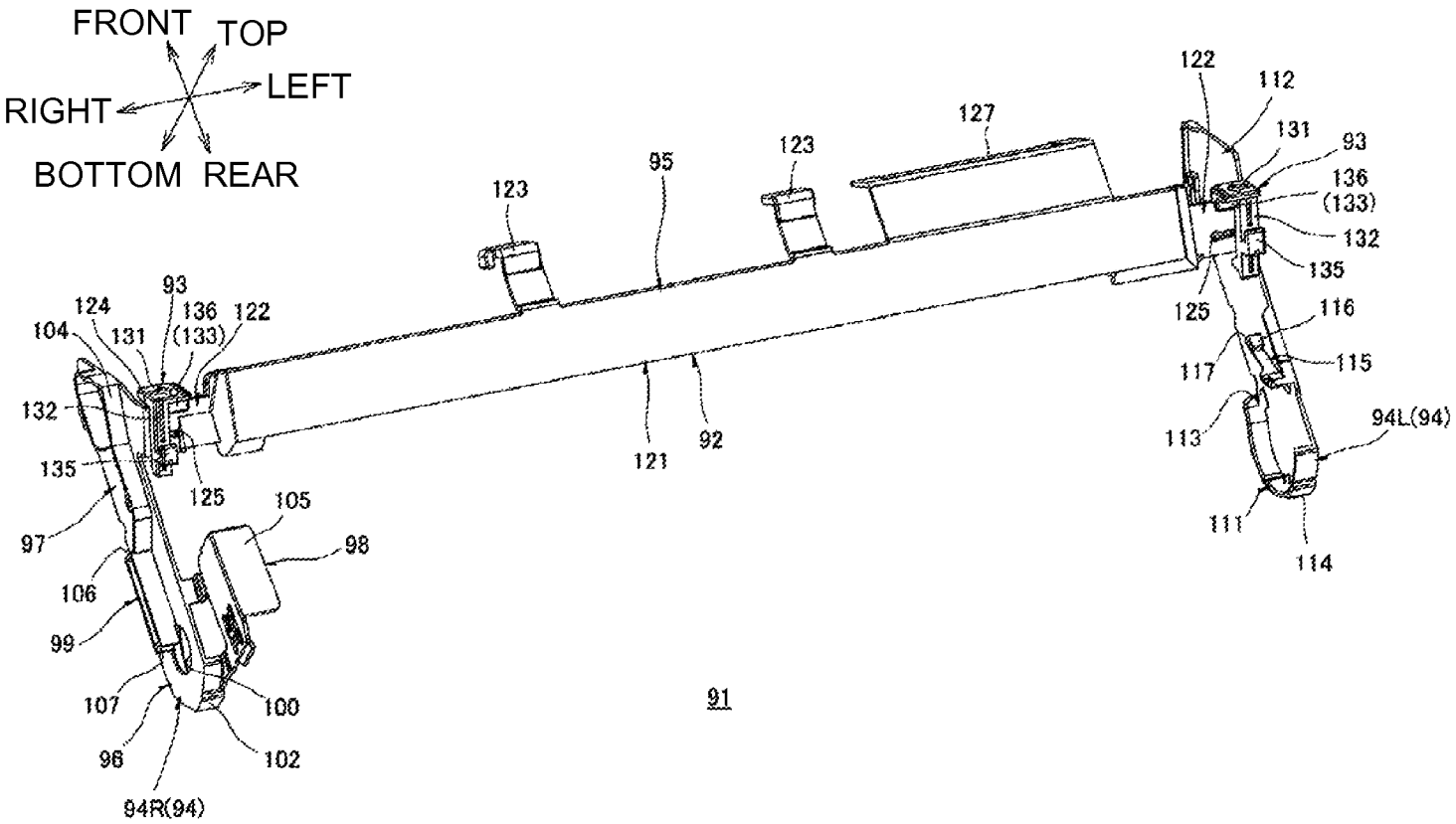
FIG. 8 is a perspective view of the bent packing member shown in FIG. 6.

Before the process cartridge 5 is wrapped with the packing member 91, the packing member 91 is bent at the bending portions 124 such that the lower surfaces of the covering portions 94 face to inside in the left-right direction as shown in FIG. 8.

Figure 9:
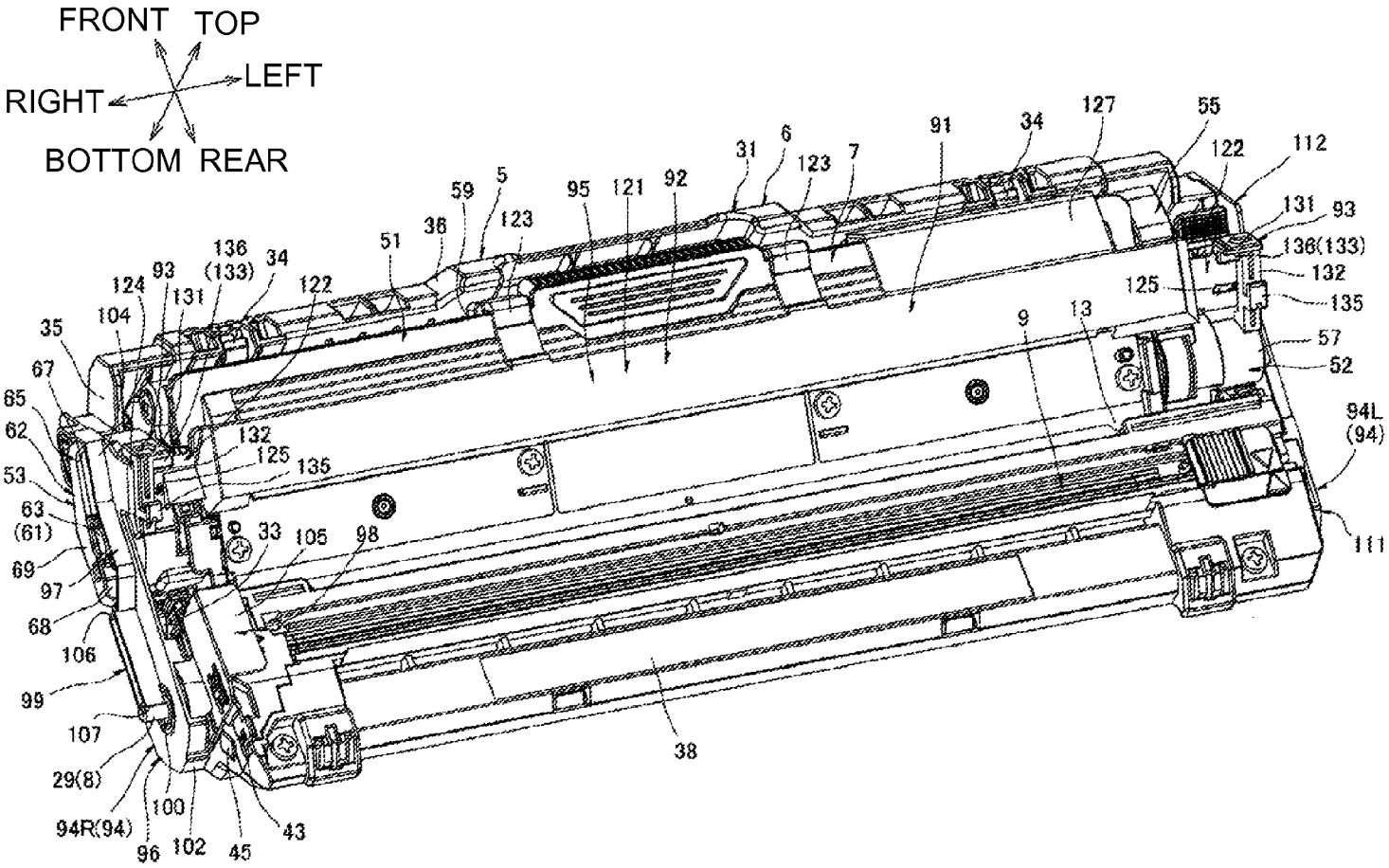
FIG. 9 is a perspective view of the process cartridge shown in FIG. 2 to which the packing member is attached.

As shown in FIG. 9, the connecting portion 95 of the packing member 91 is disposed facing the upper side of the developing cartridge 7 such that the upper ends of the developing cartridge engagement portions 123 is engaged with the upper end portion 59 of the developing cartridge 7. Thus, the developing cartridge engagement portions 123 restrict the upward movement of the developing cartridge 7.

At this time, the protrusion 127 of the packing member 91 is also engaged with the upper left end portion of the developing cartridge 7. With the protrusion 127, an indication instructing a user to remove the packing member 191 from the process cartridge 5 before first use can be marked on the upper end portion of the process cartridge 5. Thus, when the process cartridge 5 is used, the user can surely remove the packing member 91 as the indication marked on the protrusion 127.

Then, the left and right covering portions 94 are attached to the left and right ends of the process cartridge 5.

Figure 10A:
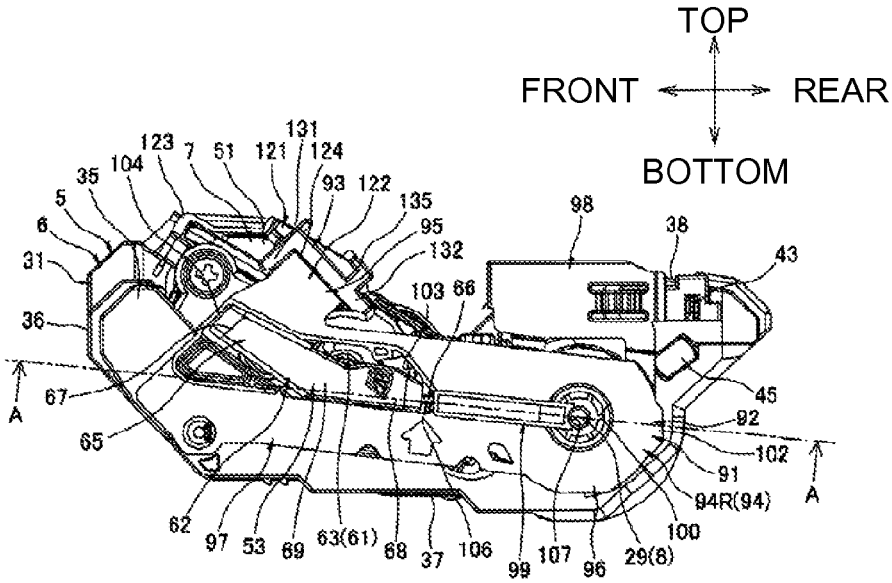
FIG. 10A is a right side view of the process cartridge shown in FIG. 9.

As shown in FIG. 10A, when the right covering portion 94R is attached to the right end of the process cartridge 5, the power receiving portion protection portion 65 and the separation engagement portion 66 are fitted in the power supply unit engagement hole 103 of the right covering portion 94R. Thus, the separation engagement portion 66 contacts the front surface 106 of the separation portion 99 of the right covering portion 94R from the front side.

While the power supply-side cover 62 is pulled to the front side, the bearing member engagement portion 96 is fitted around the bearing portion 46 of the right bearing member 32 such that the rear surface 107 of the separation portion 99 engages with the shaft 29 from the front side. At this time, the shaft 29 protrudes rightward from the shaft exposure opening 100 more than the right surface of the right covering portion 94. The supporting boss engagement portion 47 of the right bearing member 32 is received in the engagement portion receiving groove 101 of the right covering portion 94R.

The wire electrode covering portion 98 is attached to the upper rear end portion of the drum frame 31 so as to cover the wire electrode of the drum frame 31 from the right side.

In this way, the right covering portion 94R is completely attached to the process cartridge 5.

Figure 10B:
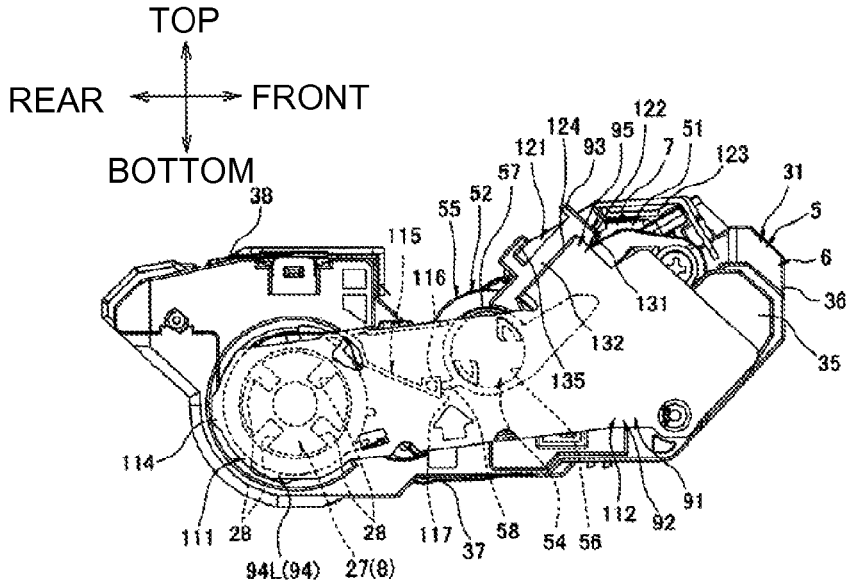
FIG. 10B is a left side view of the process cartridge shown in FIG. 9.

As shown in FIG. 10B, when the left covering portion 94L is attached to the left end of the process cartridge 5, the front surface 117 of the separation rib 115 is brought into contact with the separation engagement portion 58.

While the drive-side cover 55 is pulled to the front side, the bearing member engagement portion 111 is fitted around the bearing portion 46 of the left bearing member 32 such that the separation rib 115 faces the upper front end of the left bearing member 32 from the front side. The supporting boss engagement portion 47 of the left bearing member 32 is received in the engagement portion receiving groove 113 of the left covering portion 94L. The left flange member 27 of the drum cartridge 6 is covered with the bearing member engagement portion 111. The developing coupling 54 of the developing cartridge 7 is covered with the drive unit covering portion 112.

In this way, the left covering portion 94L is completely attached to the process cartridge 5. The process cartridge 5 is completely wrapped with the packing member 91.

With the packing member 91, the developing cartridge 7 is held in the drum cartridge 6 with the developing roller 11 being separated from the photosensitive drum 6 to the front side as shown in FIG. 11.

The following will describe how the process cartridge 5 is fixed in the main body casing 2.

As shown in FIGS. 12 and 13, each process cartridge 5 wrapped with the packing member 91 (hereinafter referred to as a wrapped process cartridge 5A) are mounted and fixed in the main body casing 2. In other words, the process cartridge 5 and the packing member 91, which are united in one, are mounted in and removed from the main body casing 2.

When the wrapped process cartridge 5A is mounted in the main body casing 2, the top cover 4 is released, the wrapped process cartridge 5A is inserted into the main body casing 2 from above such that its rear end portion faces to the lower rear side and the left and right ends are engaged into the cartridge guide grooves 72.

The right covering portion 94R is engaged in the right-side cartridge guide groove 72, and the left covering portion 94L is engaged in the left-side cartridge guide groove 72. The shaft 29 is engaged in the shaft engagement groove 74.

At this time, the fixing members 93 are disposed in the release positions.

The wrapped process cartridge 5A is pressed downward to the main body casing 2.

In the right-side cartridge guide groove 72, the protrusion 102 of the right covering portion 94R is brought into contact with the front-side positioning protrusion 73 from the upper front side.

In the left-side cartridge guide groove 72, the protrusion 114 of the left covering portion 94L is brought into contact with the front-side positioning protrusion 73 from the upper front side.

With the front-side positioning protrusions 73, insertion of the wrapped process cartridge 5A further into the main body casing 2 is restricted and the wrapped process cartridge 5A is completely mounted in the main body casing 2.

At this time, as shown in FIGS. 14 and 15, the process cartridge 5 (or the wrapped process cartridge 5A) is brought in a packing position or a first position where the photosensitive drum 8 is separated upward from the belt 19 by an amount equal to the height of the protrusion 102 of the right covering portion 94R and the protrusion 104 of the left covering portion 94L.

The photosensitive drum 8 is disposed facing a protection sheet 141 placed on the belt 19. The protection sheet 141 functions as a cushioning member made of an elastic material, e.g., a foaming member, and has substantially a flat plate shape having a thickness in the top-bottom direction.

Figure 16:
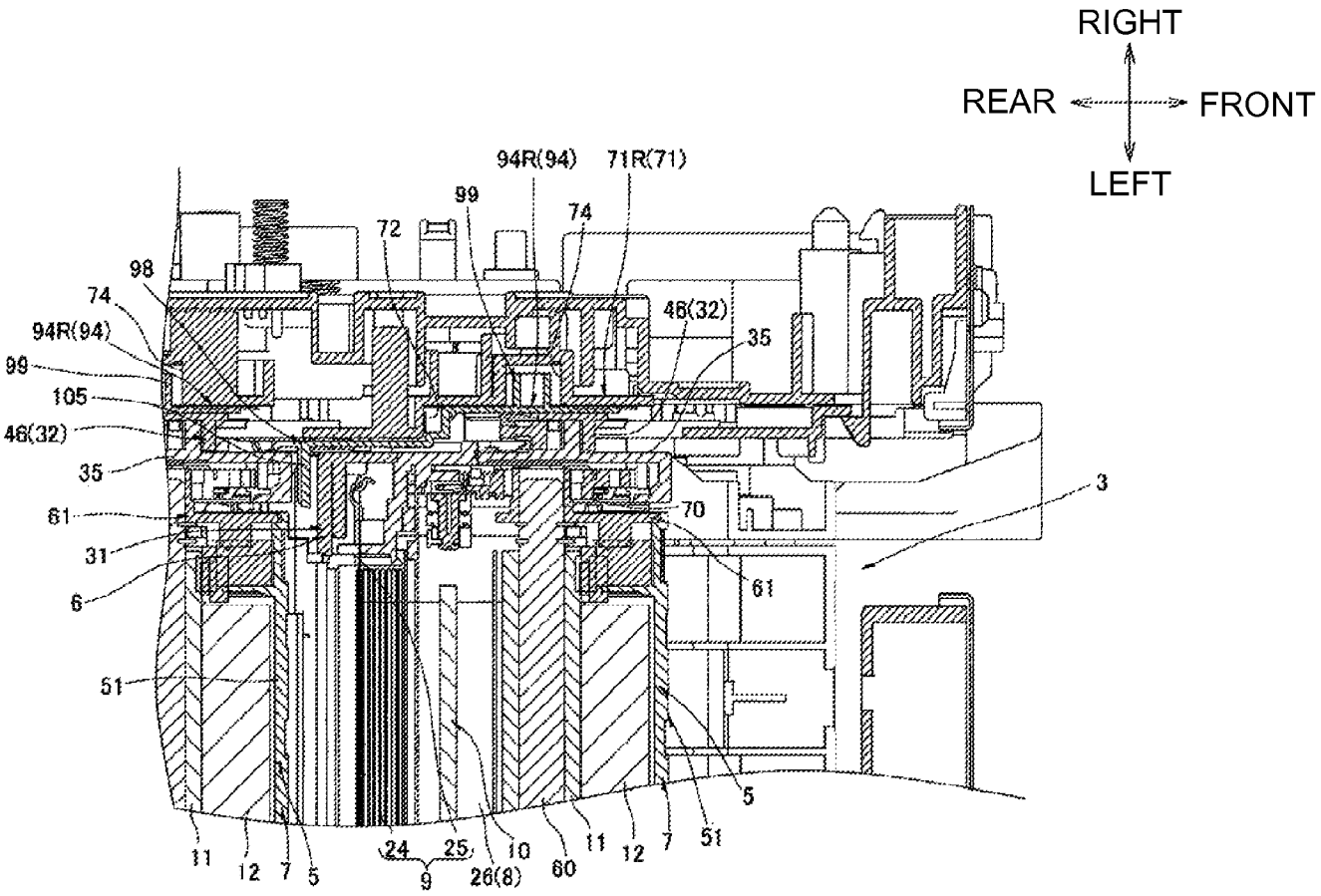
FIG. 16 is a sectional view of the printer taken along the arrowed line B-B of FIG. 14.
Figure 17:
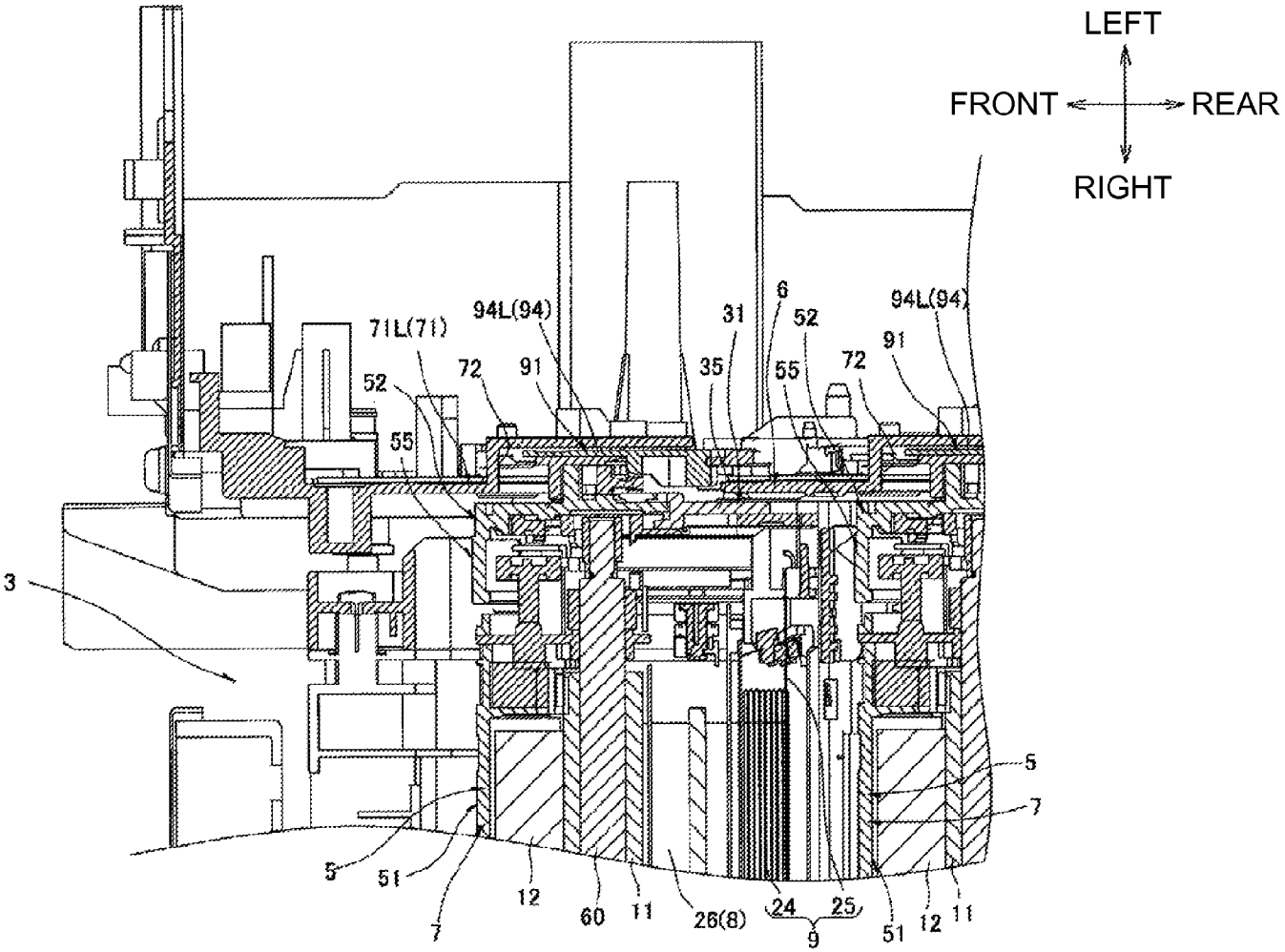
FIG. 17 is a sectional view of the printer taken along the arrowed line C-C of FIG. 15.

At this time, as shown in FIGS. 16 and 17, the right covering portion 94R faces the inner surface of the right-side cartridge guide groove 72. The left covering portion 94L faces the inner surface of the left-side cartridge guide groove 72. Thus, the right covering portion 94R restricts the rightward movement of the process cartridge 5, and the left covering portion 94L restricts the leftward movement of the process cartridge 5. In other words, the right covering portion 94R and the left covering portion 94L function as a second restraining portion.

When the wrapped process cartridge 5A is fixed in the main body casing 2, the right fixing member 93 is moved from the release position to the right side until its engagement protrusion 135 is engaged in the packing member locking groove 82. In this way, the right fixing member 93 is disposed in the fix position.

The left fixing member 93 is moved from the release position to the left side until its engagement protrusion 135 is engaged in the packing member locking groove 82. In this way, the left fixing member 93 is disposed in the fix position.

With the fixing members 93 disposed in the fix position, the vertical movement of the wrapped process cartridge 5A is restrained and the wrapped process cartridge 5A is fixed in the main body casing 2.

After all wrapped process cartridges 5A are fixed in the main body casing 2, the top cover 4 is closed. This completes mounting of all wrapped process cartridges 5 in the main body casing 2.

The following will describe the operation to install the printer 1.

After the printer 1 is unpacked, the printer 1 is placed on a horizontal surface. The top cover 4 is opened and all wrapped process cartridges 5A are removed from the main body casing 2.

When the wrapped process cartridge 5A is removed from the main body casing 2, the left and right fixing members 93 are moved from the fix positions to the release positions as shown in FIGS. 12 and 13, and then pulled upward from the main body casing 2.

After all wrapped process cartridges 5A are removed from the main body casing 2, the protection sheet 141 is removed via the main body opening 3 from the main body casing 2.

All packing members 91 are removed from the wrapped process cartridges 5A respectively.

When the packing member 91 is removed from the wrapped process cartridge 5A, the left and right covering portions 94L, 94R of the packing member 91 are removed from the left and right ends of the process cartridge 5 respectively.

When the right covering portion 94R is removed from the right end of the process cartridge 5, it is pulled to the right side while the power supply-side cover 62 is pulled to the front side.

The power receiving portion protection portion 65 and the separation engagement portion 66 of the power supply-side cover 62 are removed from the power supply unit engagement hole 103 of the right covering portion 94R, and the bearing member engagement portion 96 is removed from the bearing portion 46 of the right being member 32.

This completes the removal of the right covering portion 94R from the right end of the process cartridge 5.

When the left covering portion 94L is removed from the left end of the process cartridge 5, it is pulled to the left side while the drive-side cover 55 is pulled to the front side.

The separation engagement portion 58 is removed from the separation rib 115 of the left covering portion 94L and the bearing member engagement portion 111 is removed from the bearing portion 46 of the left bearing member 32.

This completes the removal of the left covering portion 94L from the left end of the process cartridge 5.

The connecting portion 95 of the packing member 91 is removed upward from the developing cartridge 7. This completes the removal of the packing member 91 from the process cartridge 5.

After the packing member 91 is removed from the process cartridge 5, the developing cartridge 7 is urged to the front side by the pressing member 34, and the developing roller 11 is brought into contact with the photosensitive drum 8 from the front side.

To make the printer 1 capable of image formation, all process cartridges 5 with no packing members 91 are mounted in the main body casing 2, as shown in FIG. 1.

When the process cartridge 5 is mounted in the main body casing 2, the rear end portion of the process cartridge 5 is oriented to the lower rear side, and the cartridge 5 is inserted into the main body casing 2 from above such that the right bearing member 32 is engaged in the right-side cartridge guide groove 72 and the left bearing member 32 is engaged in the left-side cartridge guide groove 72.

The process cartridge 5 is pressed downward in the main body casing 2.

In the right-side cartridge guide groove 72, the bearing member 32 is brought into contact with the front-side positioning protrusion 73 at its lower front end portion, and the rear-side positioning protrusion 73 at its lower rear end portion.

With this structure, the further insertion of the process cartridge 5 into the main body casing 2 is restrained and the process cartridge 5 is completely mounted in the main body casing 2.

At this time, as shown in FIG. 1, the process cartridge 5 is disposed in an image formation position or a first position where the photosensitive drum 8 contacts the belt 19 from above. The wire electrode 44 of the process cartridge 5 contacts the main body-side wire electrode 78 of the main body casing 2. The grid electrode 43 of the process cartridge 5 contacts the main body-side grid electrode 77 of the main body casing 2. The cleaner electrode 45 of the process cartridge 5 contacts the main body-side cleaner electrode 79 of the main body casing 2.

When the top cover 4 is then closed, the main body-side developing couplings 151 of the main body casing 2 are engaged with the developing couplings 54 and the main body-side drum couplings 150 of the main body casing 2 are engaged in the coupling engagement portions 28 of the photosensitive drums 8.

This allows the printer 1 to be ready for image forming.

When the wrapped process cartridge 5A is still mounted in the main body casing 2, the developing coupling 54 and the left flange member 27 are covered with the left covering portion 94L.

In this case, even if the top cover 4 is closed, the left covering portion 94L interrupts the engagement of the main body-side developing coupling 151 with the developing coupling 54, and the engagement of the main body-side drum coupling 150 in the coupling engagement portion 28.

When the printer 1 is turned on, power is supplied to the wire electrodes 44 of the process cartridges 5 via the main body-side wire electrodes 78 of the main body casing 2. The power is also supplied to the grid electrodes 43 of the process cartridges 5 via the main body-side grid electrodes 77 of the main body casing 2. The power is also supplied to the cleaner electrodes 45 of the process cartridges 5 via the main body-side cleaner electrodes 79 of the main body casing 2.

The continuity detecting portion 142 detects electrical continuity to the wire electrodes 44, the grid electrodes 43 and the cleaner electrodes 45, and sends a first detection signal to the CPU 143.

The CPU 143 determines that the power is supplied to the wire electrodes 44, the grid electrodes 43 and the cleaner electrodes 45, and thus determines that the process cartridges 5 are completely mounted in the main body casing 2.

Then, the printer 1 performs warm-up operation based on the control by the CPU 143.

When the wrapped process cartridge 5A is still mounted in the main body casing 2, the wire electrode covering portion 98 covers the wire electrode 44 and provides electrical isolation between the wire electrode 44 and the main body-side wire electrode 78.

Thus, when the printer 1 is turned on, the power is not supplied to the wire electrode 44 although the power is supplied to the grid electrode 43 ad the cleaner electrode 45.

In this case, the continuity detecting portion 142 detects the electrical continuity to the grid electrode 43 and the cleaner electrode 45 and sends a second detection signal to the CPU 143.

The CPU 143 determines that the power is not supplied to the wire electrode 44 and thus determines that the packing member 44 is still attached to the process cartridge 5.

The CPU 143 causes the operation panel 144 to display that the packing member 91 is attached to the process cartridge 5.

If the printer 1 is turned on without a process cartridge 5 mounted in the main body casing 2, the power is not supplied to the wire electrode 44, the grid electrode 43 and the cleaner electrode 45.

The continuity detecting portion 142 does not detect any electrical continuity to the wire electrode 44, the grid electrode 43 and the cleaner electrode 45. Thus, the continuity detecting portion 142 does not send any detection signal to the CPU 143.

After a specified time elapsed, the CPU 143 determines that the process cartridge 5 is not mounted in the main body casing 2 based on that it has not received any detection signal from the continuity detecting portion 142.

Then, the CPU 143 causes the operation panel 144 to display that the process cartridge 5 is not mounted in the main body casing 2.

According to the color laser printer 1 described in the above embodiment, the following effects can be obtained.

As shown in FIGS. 14 and 15, the packing member 91 enables the process cartridge 5 to be located in the packing position where the process cartridge 5 is separated from the photosensitive drum 8 in the main body casing 2.

As shown in FIG. 1, the process cartridges 5 from which the packing members 91 are removed, are mounted in the image formation positions where the photosensitive drums 8 contact the belt 19 so as to form images.

When the packing members 91 are attached to the process cartridges 5, the process cartridges 5 are fixed in the packing positions in the printer 1 to be transported. When the packing members 91 are removed from the process cartridges 5, the process cartridges 5 are disposed in the image formation positions in the printer 1, and the printer 1 is ready for image forming.

As a result, there is no need to separately prepare a member for mounting a process cartridge 5 in the packing position. With the packing member 91, the process cartridge 5 can be simply mounted in the packing position inside the main body casing 2.

According to the printer 1, as shown in FIG. 9, the packing member 91 includes the right protrusion 102 and the left protrusion 114, which are to be disposed between the rear-side positioning protrusion 73 of the main body casing 2 and the bearing member 32 of the process cartridge 5 when the process cartridge 5 is mounted in the packing position inside the main body casing 2.

Thus, when the process cartridge 5 is mounted in the packing position, the photosensitive drum 8 can be reliably separated from the belt 19 by the amount equal to the right protrusion 102 and the left protrusion 114.

According to the printer 1, as shown in FIGS. 12 and 13, the left and right ends of the process cartridges 5 can be fixed to the main body sidewalls 71.

With a simple structure, the process cartridges 5 can be fixed in the packing positions.

According to the printer 1, as shown in FIG. 11, when the process cartridge 5 is fixed in the packing position, the photosensitive drum 8 can be separated from the belt 19 completely in the left-right direction.

According to the printer 1, as shown in FIGS. 12 and 13, the process cartridge 5 can be reliably fixed inside the main body casing 2 with a simple structure that the fixing members 93 of the packing member 91 are moved outside in the left-right direction.

According to the printer 1, as shown in FIGS. 12 and 13, the process cartridge 5 can be mounted in and removed from the main body casing 2 in the top-bottom direction.

Thus, the main body sidewalls 71 of the main body casing 2 are utilized to restrain the process cartridges 5 from moving in the left-right direction.

According to the printer 1, as shown in FIGS. 12 and 13, the process cartridge 5 and the packing member 91, which are united as one, can be detachably mounted in the main body casing 2.

Thus, when the process cartridge 5 is mounted in or removed from the main body casing 2, the packing member 91 can be also mounted in or removed from the main body casing 2.

This prevents the packing member 91 from remaining inside the main body casing 2 when the process cartridge 5 is removed from the main body casing 2.

According to the printer 1, as shown in FIG. 8, the covering portions 94 of the packing member 91 can be removed together from the process cartridge 5 while they can be attached to the left and right ends of the process cartridge 5 reliably.

Thus, the packing member 91 can be completely removed from the process cartridge 5.

According to the printer 1, as shown in FIGS. 6 and 8, the packing member 91 is molded to have substantially a flat plate shape. When the packing member 91 is attached to the process cartridge 5, it is bent at the bending portions 124 to define the covering portions 94 to be attached to the left and right ends of the process cartridge 5.

Thus, the packing member 91 can be simplified and effectively manufactured.

According to the printer 1, as shown in FIG. 8, the fixing members 93 are disposed in the fixing portion supporting portions 122 of the connecting portion 95.

Thus, the connecting portion 95 can be utilized to locate the fixing members 93, and the packing member 91 can be manufactured in a simple structure.

According to the printer 1, as shown in FIG. 11, the packing member 91 includes the separation portion 99 and the separation rib 115 to separate the developing roller 11 from the photosensitive drum 8.

This structure prevents the photosensitive drum 8 and the developing roller 11 from being pressed against each other at a position continuously while the process cartridge 5 is fixed in the packing position.

Potential deformation of the developing roller 11 due to a long-time contact with the photosensitive drum 8 at a position can be reduced.

According to the printer 1, as shown in FIG. 9, the packing member 91 includes the developing cartridge engagement portions 123 configured to restrain the developing cartridge 7 from moving upward relative to the drum cartridge 6.

This structure reduces a chance of upward displacement of the developing cartridge 7 relative to the drum cartridge 6 due to extraneous disturbance during transportation of the printer 1.

Thus, the process cartridge 5 can be fixed in the packing position reliably.

According to the printer 1, as shown in FIGS. 16 and 17, the packing member 91 is configured such that the left and right covering portions 94, which engage in the left and right cartridge guide grooves 72 of the main body casing 2, restrain the developing cartridge 7 and the drum cartridge 6 from moving relative to each other in the left-right direction.

This structure reduces a chance of displacement of the developing cartridge 7 and the drum cartridge 6 in the left-right direction due to extraneous disturbance during transportation of the printer 1.

The process cartridge 5 can be fixed in the packing position more reliably.

According to the printer 1, as shown in FIG. 9, the packing member 91 is configured such that the wire electrode covering portion 98 covers the wire electrode 44 and provides electrical isolation between the main body-side wire electrode 78 and the wire electrode 44.

This structure prevents power supply to the wire electrode 44 of the process cartridge 5 when the laser printer 1 is turned on with the packing member 91 still remaining in the main body casing 2.

Thus, the process cartridge 5 fixed in the packing position can be prevented from working accidentally.

According to the printer 1, as shown in FIG. 4, the continuity detecting portion 142 detects whether the process cartridge 5 is mounted in the main body casing 2 and the operational panel 144 displays the detection result by the continuity detecting portion 142.

Specifically, when the laser printer 1 is turned on in a situation where the process cartridge 5 with the packing member 91 still attached is mounted in the main body casing 2, the continuity detecting portion 142 detects that the packing member 91 is still attached to the process cartridge 5, which is displayed on the operation panel 144.

Based on the message displayed on the operation panel 144, the packing member 91 can be removed reliably.

As a result, the process cartridge 5 can be mounted in the image formation position reliably.

According to the printer 1, as shown in FIG. 11, the packing member 91 is configured such that the bearing member engagement portion 111 of the left covering portion 94L is to be disposed between the main body-side drum coupling 150 and the coupling engagement portion 128 in order to interrupt the engagement therebetween.

This structure prevents the process cartridge 5 from receiving a drive force when the laser printer 1 is turned on with the packing member 91 still remaining in the main body casing 2.

Thus, the process cartridge 5 fixed in the packing position can be prevented from working accidentally.

According to the printer 1, as shown in FIGS. 12 and 13, the process cartridges 5 wrapped with the packing members 91 can be mounted in the main body casing 2. This can reduce the physical size of a carton for packing the laser printer 1.

According to the printer 1, as shown in FIGS. 14 and 15, the belt 19 is spaced apart from the photosensitive drums 8 and can be protected reliably.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body including a fixing portion;

a cartridge including a photosensitive member configured to carry an electrostatic latent image thereon, the cartridge being configured to be mounted in and removed from the main body;

a transfer unit disposed in the main body and facing the photosensitive member of the cartridge mounted in the main body, the transfer unit including a belt configured to contact the photosensitive member of the cartridge; and a separation member configured to separate the photosensitive member from the belt of the transfer unit, the separation member including a fixing portion configured to engage the fixing portion of the main body, wherein the cartridge is configured to be disposed in a first position in the main body where the photosensitive member is separated from the belt of the transfer unit, wherein the cartridge is configured to be disposed in a second position in the main body where the photosensitive member contacts the belt of the transfer unit, and wherein, when the separation member is fixed in the main body by engagement of the fixing portion of the separation member to the fixing portion of the main body, the cartridge is disposed in the first position, and when the separation member is removed from the main body, the cartridge is disposed in the second position.

2. The image forming apparatus according to claim 1, wherein the main body further includes a positioning portion configured to position the cartridge in the second position in the main body, wherein the cartridge further includes an engaging portion configured to engage the positioning portion of the main body when the cartridge is disposed in the second position in the main body, and wherein the separation member further includes a spacer portion configured to be disposed between the positioning portion and the engaging portion when the cartridge is disposed in the first position in the main body.

3. The image forming apparatus according to claim 1, wherein the main body further includes a frame facing the cartridge from outside in a longitudinal direction of the photosensitive member, and wherein the frame includes the fixing portion of the main body.

4. The image forming apparatus according to claim 1, wherein the main body further includes first and second frames spaced apart from each other in a longitudinal direction of the photosensitive member such that the cartridge is disposed between the first and second frames, and wherein each of the first and second frames includes the fixing portion of the main body.

5. The image forming apparatus according to claim 1, wherein the fixing portion of the separation member is configured to move, along a longitudinal direction of the photosensitive member, to a fixed position where the fixing portion of the separation member is fixed to the fixing portion of the main body and a release position where the fixing portion of the separation member is released from the fixing portion of the main body, and wherein the fixing portion of the main body is configured to fix the fixing portion of the separation member in the fixed position and restrain the fixing portion of the separation member fixed in the fixed position from moving in a direction perpendicular to the longitudinal direction of the photosensitive member.

6. The image forming apparatus according to claim 1, wherein the cartridge is configured to be mounted in and removed from the main body in a direction perpendicular to a longitudinal direction of the photosensitive member.

7. The image forming apparatus according to claim 6, wherein the cartridge and the separation member are configured to be mounted in and removed from the main body together.

8. The image forming apparatus according to claim 1, wherein the separation member includes a first portion to be attached to a first end of the cartridge in a longitudinal direction of the photosensitive member, a second portion to be attached to a second end of the cartridge opposite to the first end in the longitudinal direction of the photosensitive member, and a third portion connecting the first portion and the second portion.

9. The image forming apparatus according to claim 8, wherein the third portion of the separation member includes a first bending portion disposed in a portion connected to the first portion, and a second bending portion disposed in a portion connected to the second portion, and the separation member is configured to bend in the first bending portion and the second bending portion.

10. The image forming apparatus according to claim 8, wherein the fixing portion of the separation member is disposed in the third portion.

11. The image forming apparatus according to claim 1, wherein the cartridge further includes a developer carrier configured to carry developer thereon, wherein the developer carrier is configured to contact the photosensitive member and separate from the photosensitive member, and wherein the separation member includes a developer carrier separation portion configured to separate the developer carrier from the photosensitive member.

12. The image forming apparatus according to claim 1, wherein the cartridge includes a photosensitive member unit including the photosensitive member and a developing unit configured to contain therein developer to be supplied to the electrostatic latent image on the photosensitive member, and wherein the separation member includes a first restraining portion configured to restrain the photosensitive unit and the developing unit from moving relative to each other in a direction perpendicular to a longitudinal direction of the photosensitive member.

13. The image forming apparatus according to claim 1, wherein the cartridge includes a photosensitive member unit including the photosensitive member and a developing unit configured to contain developer therein, and wherein the separation member includes a second restraining portion configured to restrain the photosensitive unit and the developing unit from moving relative to each other in a longitudinal direction of the photosensitive member.

14. The image forming apparatus according to claim 1, wherein the main body includes a main body-side electrode configured to supply power to the cartridge, wherein the cartridge includes a cartridge-side electrode configured to be electrically connected to the main body-side electrode, and wherein the separation member includes an insulating portion configured to provide electrical isolation between the main body-side electrode and the cartridge-side electrode.

15. The image forming apparatus according to claim 14, wherein the main body includes a continuity detecting portion configured to detect electrical continuity between the main body-side electrode and the cartridge-side electrode, and an information portion configured to provide information on a state of the cartridge with respect to the main body, and wherein the information portion is configured to provide the information based on detection by the continuity detecting portion.

16. The image forming apparatus according to claim 1, wherein the main body includes a drive force input member configured to input a drive force to the cartridge, wherein the cartridge includes a power receiving portion configured to be connected to the drive force input member to receive the drive force from the drive force input member, and wherein the separation member includes an interruption portion disposed between the drive force input member and the power receiving portion and configured to interrupt engagement between the drive force input member and the power receiving portion.

17. The image forming apparatus according to claim 1, further comprising a further cartridge including a photosensitive member configured to carry an electrostatic latent image thereon, the further cartridge being configured to be mounted in and removed from the main body, wherein the belt of the transfer unit is configured to contact the photosensitive member of the cartridge and the photosensitive member of the further cartridge.

18. An image forming apparatus comprising:

a first wall and a second wall opposing the first wall, the first and second walls defining a cartridge accommodating portion, the first wall including a fixing portion;

a cartridge including a photosensitive member configured to carry an electrostatic latent image thereon, the cartridge being configured to be mounted in and removed from the cartridge accommodating portion;

a transfer unit disposed facing the photosensitive member of the cartridge mounted in the cartridge accommodating portion, the transfer unit including a belt configured to contact the photosensitive member of the cartridge; and a separation member configured to separate the photosensitive member from the belt of the transfer unit, the separation member including a fixed portion configured to engage the fixing portion of the first wall, wherein the cartridge is configured to be disposed in a first position in the cartridge accommodating portion where the photosensitive member is separated from the belt of the transfer unit, wherein the cartridge is configured to be disposed in a second position in the cartridge accommodating portion where the photosensitive member contacts the belt of the transfer unit, and wherein, when the separation member is fixed in the cartridge accommodating portion by engagement of the fixed portion of the separation member to the fixing portion of the first wall, the cartridge is disposed in the first position and restricted from movement in a removal direction, and when the separation member is removed from the cartridge accommodating portion in the removal direction, the cartridge is disposed in the second position.

* * * * *